US006568533B1

(12) United States Patent
Tanaka et al.

(10) Patent No.: US 6,568,533 B1
(45) Date of Patent: May 27, 2003

(54) PEELABLE PACKAGE AND PEELABLE PACKAGING METHOD

(75) Inventors: Nobuyoshi Tanaka, Hirakata (JP); Naoru Hamaguchi, Ibaraki (JP); Shuji Morimoto, Suita (JP)

(73) Assignee: Takeda Chemical Industries, Ltd., Osaka (JP)

( * ) Notice: Subject to any disclaimer, the term of this patent is extended or adjusted under 35 U.S.C. 154(b) by 0 days.

(21) Appl. No.: 09/719,692

(22) PCT Filed: Jun. 14, 1999

(86) PCT No.: PCT/JP99/03143

§ 371 (c)(1),
(2), (4) Date: Dec. 15, 2000

(87) PCT Pub. No.: WO99/65789

PCT Pub. Date: Dec. 23, 1999

(30) Foreign Application Priority Data

Jun. 16, 1998 (JP) ..... 10-167990
Dec. 15, 1998 (JP) ..... 10-355489
Jan. 22, 1999 (JP) ..... 11-013848

(51) Int. Cl.[7] ..... B65D 83/04

(52) U.S. Cl. ..... 206/484; 206/530; 206/534.1; 383/210

(58) Field of Search ..... 206/484, 484.2, 206/440, 528, 530, 534.1, 534.2, 539; 383/207, 210, 211; 53/450, 460; 493/186, 189, 199, 227, 228

(56) References Cited

U.S. PATENT DOCUMENTS 3,123,210 A * 3/1964 Hermanson et al. ..... 206/484.2
3,163,288 A * 12/1964 Arvidsson ..... 206/484
3,189,174 A * 6/1965 Cormack ..... 383/210
3,332,549 A * 7/1967 Powell ..... 383/210
3,342,326 A * 9/1967 Zackheim ..... 383/210
3,616,898 A * 11/1971 Massie ..... 206/484
3,926,311 A * 12/1975 Laske ..... 383/210
5,358,118 A 10/1994 Thompson et al.
5,366,296 A * 11/1994 Stenstrom et al. ..... 383/210

FOREIGN PATENT DOCUMENTS

| | | |
|---|---|---|
| JP | 42-1516 | 1/1967 |
| JP | 53-93990 | 8/1978 |
| JP | 62-101542 | 6/1987 |
| JP | 8-503910 | 4/1996 |
| WO | 94/07761 | 4/1994 |

OTHER PUBLICATIONS

Microfilm of the specification and drawings annexed to the request of Japanese Utility Model Application No. 60–108719 (Laid–open No. 62–17570) (Kao Corp.), Feb. 2, 1987.

Microfilm of the specification and drawings annexed to the request of Japanese Utility Model Application No. 56–118506 (Laid–open No. 58–25144) (Inogashira Shouji K.K.), Feb. 17, 1983.

Microfilm of the specification and drawings annexed to the request of Japanese Utility Model Application No. 52–122887 (Laid–open No. 54–52477) (Eisai Co., Ltd.), Apr. 11, 1979.

Microfilm of the specification and drawings annexed to the request of Japanese Utility Model Application No. 52–14688 (Laid–open No. 53–110383) (Nitto Electric Industrial Co., Ltd.), Sep. 4, 1978.

* cited by examiner

*Primary Examiner*—Luan K. Bui
(74) *Attorney, Agent, or Firm*—Wenderoth, Lind & Ponack, L.L.P.

(57) ABSTRACT

An object (7) to be packed is sandwiched between sheet-like package materials (2,2). A weakly-sealed portion (4) is formed so as to surround the packed object (7) while leaving a grip flap (3) for each of the package materials (2,2), thereby forming a bag portion (5) which accommodates the packed object (7) within the weakly-sealed portion (4). The grip flap (3) has a length (L) set to about 20 mm for easy handling. The weakly-sealed portion (4) can be peeled by grasping and pulling the grip flap (3) to take out the packed object (7) within the bag portion (5).

15 Claims, 25 Drawing Sheets

Fig. 17

COMPARISON TEST 1. PEELING (ADHESION) STRENGTH AT RESIN LUMP

| ONE PACKAGE FILM | OTHER PACKAGE FILM | GAP BETWEEN SEALING MEANS (μm) | SEALING TEMPERATURE (℃) | PEELING STRENGTH (ADHESION STRNGTH) (g/15mm) |
|---|---|---|---|---|
| PET + PP + PEELABLE LAYER | PET + PP | 80 | 135 | 460 |
| PET + PP + PEELABLE LAYER | PET + PP | 10 | 135 | 614 |
| PET + PP + PEELABLE LAYER | PET + PP | 80 | 150 | 410 |
| PET + PP + PEELABLE LAYER | PET + PP | 10 | 150 | 2840 |
| (COMPARISON EXAMPLE) PET + PP | PET + PP | 80 | 135 | 3745 |

Fig. 19

COMPARISON TEST 2. PEELING (ADHESION) STRENGTH WHEN SEALING TEMPERATURE HAS BEEN CHANGED.

| SEALING TEMPERATURE (℃) | PEELING STRENGTH AT WEAKLY SEALED PORTION (g/10mm) | PEELING (ADHESION) STRENGTH AT RESIN LUMP (g/10mm) |
|---|---|---|
| 140 | 263 | 328 |
| 145 | 327 | 578 |
| 150 | 338 | 943 |
| 155 | 317 | 1156 |
| 160 | 318 | 855 |
| 165 | 328 | 869 |

Fig. 24

COMPARISON TEST 3. PEELING (ADHESION) STRENGTH WHEN PREHEATING CONDITIONS HAVE BEEN CHANGED.

| PREHEATING CONDITIONS | | PEELING STRENGTH AT WEAKLY SEALED PORTION (g/8.5mm) | PEELING (ADHESION) STRENGTH AT RESIN LUMP (g/8.5mm) |
|---|---|---|---|
| HEATING TEMPERATURE | HEATING TIME | | |
| --- | 0 | 214 | 309 |
| 190~210 ℃ | 2 SECONDS | 383 | 578 |
| 190~210 ℃ | 4 SECONDS | 571 | 792 |

PEELABLE PACKAGE AND PEELABLE PACKAGING METHOD

BACKGROUND OF THE INVENTION

1. Technical Field

The present invention relates to a peelable package capable of keeping its interior airtight when closed and easily opening by being pulled and peeled with a relatively weak force, if required, and to a peelably packaging method. More specifically, the present invention concern a peelable package which can be easily opened by even a person having handicapped fingers. The peelable package can readily open up to a predetermined position in an opening direction with a peeling strength abruptly increased at the predetermined position, and stop opening with assuredness at the predetermined position. Besides, it can be put into practice easily and inexpensively.

2. Background Art

A known example of a package for a tablet or the like is a so-called peelable package which arranges a tablet or the like object to be packed between, for example, two package sheets and adheres predetermined portions of both sheets to each other with heat and under pressure to form a weakly-sealed portion around the object to be packed. This peelable package is provided with a grip flap at an end of each sheet. The sheets are peeled and separated from each other by grasping the grip flaps to open the weakly-sealed portion and take out the packed object.

At least one of the sheets composing the peelable package has an inner surface on which a peelable layer is formed from a resin having little strength so as to be able to peel the respective sheets without damaging them. The grip flap mostly has a length set to a minimum width that finger tips can pick up, for example, about 5 mm, in order to make the medicine package compact.

However, the prior art has the following problems:

(A) It is not easy to open by picking up the grip flaps each set to about 5mm with finger tips for a patient, e.g., a rheumatoid patient, who experiences difficulty when moving his finger tips delicately and pulling an object with a force put on his finger tips;

(B) The peelable package can easily open by pulling and peeling both sheets with a relatively weak force. However, while an insufficient opening size makes it impossible to take out the packed object, an excessive opening makes the packed object readily jump out of the package. Therefore, it is not easy to open the package up to an adequate position;

(C) The packed object is likely to jump out because the grip flaps of both sheets are unsealed by both hands so as to result in opening the package too much. When the jumped out object is received with hands and picked up by finger tips, it may become unsanitary due to the dirt on finger tips and the like. Further, there is a likelihood that the jumped out object might fall on the floor due to failure to satisfactorily receive it. Therefore, it might be lost or dirtied and damaged.

More specifically, for instance, as shown in FIG. 25, the conventional peelable package forms its rear part as a ]-shaped sealed portion 89 and has a non-sealed area 87 formed so as to extend to a rear end portion of a weakly-sealed portion 83 in the same width. Thus, as shown in FIG. 25(A), before opening the rear part, a tablet 82 is sandwiched between two vertical upright package sheets 81,81, and each sheet 81 has a horizontal bulge 88 in an amount corresponding to the tablet 82. When the package starts opening from this state to a bottom side 90 as shown in FIG. 25(B), both sheets 81,81 are horizontally opened. In other words, both sheets 81,81 let the bulges 88 quickly disappear somewhere between a state shown in FIG. 25(A) and a state shown in FIG. 25(B) to become planar. During the process while these bulges 88 quickly disappear, the tablet 82 on the sheets 81,81 receives reaction therefrom to jump out in many cases. Further, as shown in FIG. 25(B), when it reaches the bottom side 90 of the ]-shaped sealed portion 89, the weakly-sealed portion 83 rapidly increases its area. This results in abruptly stopping the peeling operation at a position of the bottom side 90. At this time, the sheets 81,81 undergo stress to vertically vibrate with ease, thereby causing the tablet 82 to fall down more easily.

Then, for example, as disclosed in Japanese Patent Public Disclosure No. 3-111267, one of the conventional peelable packages increases a sealing width at a midway portion in an opening direction of a weakly-sealed portion to enhance a peeling strength of the thus widened portion so as to stop the opening operation at an appropriate position.

More specifically, as shown in FIG. 26, this peelable package has a peelable layer formed on either surface of at least one of package sheets 81*a*, which layer is adhered with heat and under pressure to the other package sheet 81*b*, thereby forming the weakly-sealed portion 83 around the object 82 to be packed. The weakly-sealed portion 83 forms at its midway portion in an opening direction a wide portion 84 where a sealing width of the weakly-sealed portion 83 is increased.

When opening this peelable package 80, both sheets 81*a* and 81*b* are peeled and separated from each other by holding grip flaps 85 until they experience an enhanced opening resistance at the wide portion 84 having a peeling strength higher by an amount corresponding to the increase of the sealing width. As a result, the opening operation stops at this wide portion 84. There may be expected an effect of preventing the packed object from jumping out.

However, the conventional technique has increased this sealing width at its midway portion and therefore has the following problems:

(D) The above-mentioned package is directed to a relatively large product such as a test instrument. It is used in a case where the product has a portion disclosed and the disclosed portion is gripped to take the product out thereof Therefore, as for a small and light products such as a tablet, even if a bag portion of the package has a portion opened, it does not assure the capability of taking out all the tablets without failure. Further, it will become difficult for a person having handicapped finger tips to take the tablets out of the bag portion having only a portion opened without dropping the tablets. This results in a need to open a large part of the bag portion or fully open it. Therefore, it is desired to use a technique so as to prevent the tablet or the like from falling out while opening the large part of the bag portion or fully opening it.

(E) In general, the package cannot be made excessively larger than the object to be packed. If made excessively larger, it causes an economical disadvantage. Therefore, the wide portion 84 is limited, at largest, to about twice a width of the portion of the weakly-sealed portion 83 to be opened up thereto. However, the weakly-sealed portion of the peelable package is smoothly going to separate once it starts peeling. Accordingly, even if the peeling strength becomes about as large as twice an initial one at a halfway point, this does not resist the opening so much that it subsequently separates the wide portion to result in being apt to open the package to more than a predetermined length. As a result, even the conventional technique is still likely to let the packed object jump out and fall on the floor inadvertently.

The following is an example of other methods for increasing the peeling strength at a proper position in a direction of opening a weakly-sealed portion.

It is a method of utilizing a peelable package material made through a so-called part coating which forms a peelable layer only on a portion to be opened, and adheres substrate resin directly to the other package material at the other portion. However, this example requires precise positioning of the portion forming the peelable layer and the portion accommodating the object to be packed, which makes it difficult to put it into practice. In addition, many kinds of peelable package materials must be prepared depending on the shape and size of the object to be packed. Thus it has a problem of being troublesome and unable to be put into practice inexpensively.

In view of the above-mentioned problems, the present invention has been created. It has an object to provide a peelable package and a peelably packaging method capable of solving these problems.

Concrete examples of the object are mentioned below.

(a) Providing a peelable package able to be easily opened by even a rheumatoid patient or the like person having handicapped fingers who encounters difficulty in picking up an object by his finger tips, without imposing any particular burden on him;

(b) Inhibiting the packed object from jumping out and falling from the package sheets even if a bag portion is completely opened to the end when opening a peelable package which accommodates a small and light packed object;

(c) Preventing the packed object from jumping out and falling from the package sheets while opening a large part up to a predetermined position of the bag portion when opening the peelable package;

(d) Providing a handy peelable package for storing or carrying a plurality of easily openable and peelable packages all together; and (e) Providing a peelable package which can easily open up to a predetermined position in an opening direction with a peeling strength abruptly increased at the predetermined position and stop the opening operation at the predetermined position with assuredness, and which can be put into practice readily and inexpensively, as well as a method of producing such a peelable package.

SUMMARY OF THE INVENTION

The present invention is a peelable package and a method of producing such a peelable package in the following manner, and it is explained based on, for example, FIGS. 1 to 24 illustrating embodiments of the present invention.

A first aspect has been made by focusing on the fact that it is easier for a rheumatoid patient or the like who experiences difficulty when making a delicate movement of his finger tips, to hold a grip flap between a side surface of his thumb and that of his forefinger (as for a person who cannot move his thumb, between a side surface of his forefinger and that of his middle finger) as shown in FIG. 2 rather than to pick it up with finger tips.

More specifically, the first aspect relates to a peelable package. Sheet-like package materials 2,2 sandwiches an object 7 to be packed therebetween. The package materials 2 are provided with a weakly-sealed portion 4 so as to surround the packed object 7 while leaving a grip flap 3 for each of the package materials 2, thereby forming a bag portion 5 which accommodates the packed object 7 within a non-sealed area 6. The packed object 7 in the bag portion 5 is taken out by grasping and pulling the grip flaps 3 to peel the weakly-sealed portion 4. Assuming that extension lines are drawn from points on a boundary line 21 between the weakly-sealed portion 4 and the grip flap 3, the grip flap 3 is provided with an area 23 where the extension lines are cut by a grip flap outer edge 3*a* to each have a length of at least 10 mm.

Thus, since the shape of the grip flap is set so as to have a length of at least 10 mm, the grip flap can be held between side surfaces of fingers like the thumb and the forefinger or the forefinger and the middle finger. Therefore, the peelable package can be easily opened by even a rheumatoid patient or the like person having handicapped fingers who experiences difficulty in picking up an object with his finger tips, without imposing any particular burden on himself. However, the area having the length of at least 10 mm is preferably not more than 100 mm.

As mentioned above, if extension lines are drawn from points on a boundary line 21 between the weakly-sealed portion 4 and the grip flap 3, the grip flap 3 is provided with an area 23 where the extension vertical lines are cut by a grip flap outer edge 3*a* to each have a length of at least 10 mm. If this is explained by relying on, for example, FIG. 8, assuming that vertical lines are drawn from points (P1)–(Pn) on the boundary line 21 between the weakly-sealed portion 4 and the grip flap 3 perpendicularly to the boundary line 21, the grip flap 3 is provided with the area 23 where the extension lines (22*i*) to (22*k*) are cut between the points (Pi) to (Pk) and the grip flap outer edge 3*a* to each have a length (M) of at least 10 mm.

In short, this means that when the patient picks up the grip flap 3 unintentionally so as to open the peelable package by unsealing the weakly-sealed portion 4 as shown in FIG. 2, each grip flap 3 has the area 23 of at least 10 mm length where he can substantially do the movement shown in FIG. 2. As shown in FIG. 1, in the event that the weakly-sealed portion 4 has a front tip 9*a* on the grip flap side, the extension line may be imagined with the front tip 9*a* slightly rounded.

A second aspect relates to another peelable package. Sheet-like package materials 2,2 sandwich an object 7 to be packed therebetween. The package materials 2 are provided with a weakly-sealed portion 4 so as to surround the packed object 7 while leaving a grip flap 3 for each of the package materials 2,2, thereby forming a bag portion 5 which accommodates the packed object 7 within a non-sealed area 6. The object 7 packed in the bag portion 5 can be taken out by grasping and pulling the grip flap 3 to peel the weakly-sealed portion 4. The weakly-sealed portion 4 is formed so that a non-sealed area 6 gradually narrows in a direction toward a rear part of the bag portion 5.

Thus the weakly-sealed portion is constructed so that the non-sealed area gradually narrows in the direction toward the rear part of the bag portion. As a rear part of the weakly-sealed portion is going to be unsealed, the packed object moves within a decreasing range in the bag portion to inhibit the movement of the packed object on the package material, accompanying the opening operation. This can prevent the packed object from falling or the like. Consequently, even if the bag portion is completely opened at the end, the packed object can be prevented from moving, which leads to the possibility of solving the problem that the packed object readily falls as it was caused by the conventional technique.

Besides, as mentioned above, the weakly-sealed portion is formed so that the non-sealed area gradually narrows in the direction of the rear part of the bag portion. This provides an advantage of being able to inhibit the vibration of the package material to thereby prevent the jumping-out of the packed object even if the bag portion is fully opened.

More specifically, for example, as shown in FIG. 5(A), before opening the rear part, each of the package sheets 2,2 has a horizontal bulge 29 because the tablet 7 is packed therebetween, as in the conventional construction. But the non-sealed area 6 gradually narrows in the direction toward a front part of a rear inverted V-shape sealed portion 11. Thus, as the weakly-sealed portion 4 is peeled, the non-sealed area 6 where the packed object can freely move in the bag portion 5 gradually narrows. Therefore, as shown from FIGS. 5(A) to 5(B), during the process of peeling the weakly-sealed portion 4 until it reaches a bottom point 30 of the rear inverted V-shape, the bulge 29 of each sheet 2 progressively disappears to result in seldom causing a phenomenon such as the tablet 7 jumping out of the sheets 2 upon receipt of reaction therefrom. In consequence, it is possible to inhibit the jumping-out of the packed object even if the weakly-sealed portion 4 is opened to the rearmost end because the weakly-sealed portion 4 is constructed so that the non-sealed area 6 gradually narrows in the direction toward the rear part of the bag portion 5. The advantage of the second invention can be well understood as a reality if the peelable package made as shown in FIG. 5 and the conventional one made as shown in FIG. 25 are actually opened.

To construct the weakly-sealed portion so that the non-sealed area gradually narrows in the direction toward the rear part of the bag portion as set forth in the second aspect includes forming the rear part of the bag portion in the shapes of letters 'V', 'U', a semicircle or the like. To shape the non-sealed area so that it gradually narrows may also include narrowing it step by step like a staircase. But it is more preferable to narrow it smoothly and continuously like the shapes of letters 'V', 'U', or a semicircle rather than to narrow it step by step.

The non-sealed area may be gradually narrowed by arranging the rear part of the weakly-sealed portion 4 with two sides 26,26 inclined with respect to an opening direction 24 of the bag portion 5, for example, as shown in FIG. 8. Further, it is preferable to construct the rear part of the weakly-sealed portion 4 so that a center line 31 of the bag portion 5, is made coincident with the opening direction 24 of the bag portion 5, and the rear part is rendered symmetrical with respect to the center line 31 of the bag portion 5 in a left and right direction. This is because the rear part of the weakly-sealed portion 4 is peeled in the same state on both the left and right sides when peeling the weakly-sealed portion 4 due to the symmetrical construction in the left and right direction, thereby stabilizing the sheet surfaces. The foregoing shapes of letters 'V', 'U' or a semicircle are all symmetrical in the left and right direction.

Moreover, in the second invention, if the weakly-sealed portion 4 is constructed so as to progressively increase its area in a direction toward its rear part, for example, as shown in FIG. 5, it gradually increases its area until it reaches the bottom point 30 as the package is going to be opened. Thus a gradually increasing force is required in order to continue the unsealing operation, which naturally reduces an unsealing speed. This assures a slow movement of the sheets 2 when the weakly-sealed portion 4 finishes opening to thereby decrease a likelihood of the tablet 7 falling out.

The second aspect does not exclude such a construction that the weakly-sealed portion 4 does not increase its area at the rear part of the bag portion 5, for example, as shown in FIG. 12.

In the first or the second aspect, it is possible to set the peeling strength behind a predetermined position of the bag portion 5 larger than that of the weakly-sealed portion 4 in front of the predetermined position. Due to this arrangement, in the event that the weakly-sealed portion is peeled with a force of a predetermined largeness, the opening operation can be stopped at the position where the peeling strength becomes larger. Accordingly, the packed object can be taken out in a state where the bag partion is opened up to a preferable position.

Particularly, as for the second invention, in the case where the peeling strength behind the predetermined position is set larger than that of the weakly-sealed portion in front of the predetermined position, for example, as shown in FIG. 4, a cavity 13 narrowing forwardly is formed during the unsealing operation of the weakly-sealed portion since the non-sealed area gradually narrows forwardly. Therefore, if the peeling strength is arranged to become large at a predetermined position where such a preferable cavity is formed, it is possible to stop the opening operation once at that position. At that stop position, the existence of the cavity restricts the movement of the packed object over the package materials to further inhibit the falling-down of the packed object from the package materials and the like.

A third aspect relates to still another peelable package. Sheet-like package materials 2,2 sandwich a plurality of objects 7 to be packed therebetween. The package materials 2,2 are provided with weakly-sealed portions 4 so as to surround the respective packed objects 7 while leaving an area which comes to a grip flap 3 for each of the package materials 2, thereby forming a plurality of bag portions 5. The package, materials 2 are each provided with cut lines 17 so as to be able to individually cut and separate peelable packages 1 each provided with a bag portion 5 and a grip flap 3 for the bag portion 5. There is provided a sealed portion 18, which prevents the grip flap 3 from peeling, along the cut line 17 within the grip flap 3 of each peelable package 1. When a peelable package 1 is cut and separated along the cut line 17, assuming extension lines 22 are drawn from points on a boundary line 21 between the weakly-sealed portion 4 and the grip flap 3 of the peelable package 1, the grip flap 3 is provided with an area 23 where the extension lines 22 are cut by a grip flap outer edge 3*a* to each have a length of at least 10 mm.

The third aspect produces an advantage of improving a handiness because the plurality of peelable packages can be held all together at once. Further, being provided with the anti-peeling sealed portion, it can inhibit the weakly-sealed portion from being unsealed by the movement of the grip flap. Further, the anti-peeling sealed portion is arranged to be formed along the cut line. This can inhibit movement of the package materials to thereby facilitate the formation of the cut lines during production.

On taking the packed objects out of the peelable packages, the independent peelable packages are cut and separated along the cut lines, and then the anti-peeling sealed portions are unsealed by picking up the grip flaps. Thereafter, the weakly-sealed portions are pulled and peeled to open the bag portions and take out the packed objects. At this time, since each grip flap has an area of at least 10 mm length, even a person with handicapped fingers can easily open the peelable packages without imposing any particular burden on himself.

Before providing patients with peelable packages, for instance, the hospital staff may cut and separate the independent peelable packages along the cut lines and unseal the anti-peeling sealed portions by picking up the grip flaps, or the patients themselves may do so.

A fourth aspect relates to still another peelable package. A peelable layer 37 is formed on either surface of at least one of the package materials 2*a*. The peelable layer 37 is adhered with head and under pressure to the other package material 2*b*, thereby forming a weakly-sealed portion 4 around an object 7 to be packed. At least one portion of a further extension area from a mid portion in an opening direction of the weakly-sealed portion 4 is provided with a resin lump 39 by fluidizing with heat, part of resin constituting the package material 2*a* and collecting the fluidized resin. The resin lump 39 has an adhesion strength enhanced more than that of the weakly-sealed portion 4.

According to the fourth aspect, the weakly-sealed portion is formed by adhering the peelable layer formed on one surface of a substrate resin layer with heat and under pressure to the other package material. The thus formed weakly-sealed portion surely seals the surroundings of the packed object. But its adhesion strength is weak enough for the weakly-sealed portion to be readily opened by pulling and peeling it while grasping the grip flaps and the like provided at the ends. When an opening position reaches the resin lump, which has a larger adhesion strength than the weakly-sealed portion, an opening resistance suddenly increases at this position, so that it can be clearly recognized where to stop opening. Thus, the opening operation can be assuredly stopped at this predetermined position.

As a result, while the package of the present invention can be readily opened as far as the packed object is taken out, it is not excessively opened to result in the possibility of removing the likelihood that the packed object inadvertently jumps out of the package, falls on the floor or the like.

Further, this fourth aspect can employ a peelable package material which has a peelable layer formed over entirety of one of its surfaces. This dispenses with a need for precisely positioning a portion for accommodating the packed object with respect to the peelable package material, and another need for preparing many sorts of package materials for the objects to be packed, which have various shapes and sizes. This can put the fourth aspect into practice easily and inexpensively.

The peelable layer 37 is, in general, formed on either surface of a substrate resin layer 36 of the package material 2*a*. In this case, the peelable layer 37 is disturbed at the resin lump 39 due to fluidization caused by heat, and the substrate resin at the resin lump 39 is directly adhered to the other package material 2*b* through the thus disturbed portion of the peelable layer 37. This can enhance the adhesion strength of the resin lump 39 and set its strength adhering with the other package material far larger than that of the weakly-sealed portion by properly choosing the kind of substrate resin.

In the case where the peelable layer 37 comprises a first resin 37*a* forming a continuous phase and second resin particles 37*b*dispersed in the first resin, the fluidization caused by heat within the resin lump 39 deforms the second resin particles 37*b*dispersed in the first resin 37*a* to result in the possibility of increasing the adhesion strength of the resin lump 39. More specifically, the second resin particles dispersed in the first resin are ordinarily flat in a direction of the peelable layer, so that a surface of each second resin particle, namely an area of an interface between each second resin particle and the first resin, is large and an interspacing between the second resin particles is narrow. In consequence, the weakly-sealed portion formed by adhering the peelable layer with heat and under pressure readily starts peeling from the interface between the first resin and each second resin particle upon receipt of an external force and, ultimately, the first resin of the continuous phase coagulates and breaks. Then it is peeled off by a relatively weak force.

On the other hand, at the resin lump, when the resin is fluidized with heat, the second resin particles dispersed in the first resin tend to deform into more stable spheres. This decreases the area of the interface between each second resin particle and the first resin and increases the interspacing between the second resin particles. As a result, this resin lump has a larger adhesion strength than the weakly-sealed portion.

It is preferable to elongate the resin lump 39 of the fourth aspect in a direction substantially perpendicular to the opening direction of the weakly-sealed portion. This can increase the adhesion width of the substrate resin at the resin lump with respect to the opening direction. Therefore, the opening resistance at this position can be increased more apparently, which leads to the possibility of surely stopping the opening operation.

The fifth aspect relates to still another peelable package. Either surface of at least one of the package materials 2*a* is provided with a peelable layer 37, which is adhered with heat and under pressure to the other package material 2*b* to form a weakly-sealed portion 4 around an object 7 to be packed. The peelable layer 37 comprises a first resin 37*a*forming a continuous phase and second resin particles 37*b* dispersed in the first resin 37*a*. At least one portion of a further extension area from a mid portion in an opening direction of the weakly-sealed portion 4 is heated to deform the second resin particles 37*b* dispersed in the first resin 37*a*. The heated portion 48 has an adhesion strength larger than a front end side portion in the opening direction of the weakly-sealed portion 4.

The fifth aspect forms the weakly-sealed portion by adhering the peelable layer provided on either surface of the substrate resin layer with heat and under pressure to the other package material as well as the fourth aspect. The thus formed weakly sealing portion surely seals the surroundings of the packed object, but its adhesion force is weak. Therefore, it is easily opened by pulling and peeling while grasping the grip flaps provided at the ends. When the opening position reaches the heated portion where the second resin particles dispersed in the first resin deform to decrease the area of interface between the first resin and each of them and to increase the interspacing therebetween with the result of enhancing the adhesion strength to more than that of the other weakly-sealed portion, namely the front end side portion in the opening direction, the opening resistance abruptly increases at this position so as to be able to clearly recognize the position to stop the opening.

As a result, also in this fifth aspect, while the package is easily opened so far as the packed object is taken out, it is not excessively opened. This results in the possibility of removing the likelihood that the packed object inadvertently jumps out, falls on the floor or the like. Further, it is possible to employ a peelable package material having one of its surfaces provided with the peelable layer over its entirety. This dispenses with a need for precisely positioning the portion for accommodating the packed object with respect to this peelable package material and another need for preparing many sorts of package materials for the objects to be packed, which are different in shape and size. Therefore, it can be put into practice readily and inexpensively.

In the fifth aspect, although at least one portion of the further extension area from the mid portion in the opening direction may be heated after the weakly-sealed portion has been formed, a predetermined portion of the peelable layer may be preheated before it is adhered with heat and under pressure to the other package material. In this case, the peelable layer is heated while being opened before it is adhered under pressure to the other package material. Therefore, the second resin particles of dispersed phase readily deform and are fluidized and are adhered to the other package material with their interspacings increased in the further extension area from the mid portion in the opening direction. This can surely increase the adhesion strength of this portion.

The sixth aspect relates to a peelably packaging method. An object 7 to be packed is arranged between a peelable package material 2*a* provided with a peelable layer 37 on one of its surfaces and the other package material 2*b*. Both package materials 2*a*,2*b* overlaid one on another are guided between and passed through a pair of sealing means 40,40. They are adhered with heat and under pressure to each other with a gap 41 between the pair of sealing means 40,40 narrowed around the packed object 7, thereby forming a weakly-sealed portion 4 around the packed object 7. Further, there is formed a gap 42 wider than the narrow gap 41 at a position adjacent to the gap 41 between the sealing means 40,40 which forms the weakly-sealed portion 4 and at least partly of a further extension area from a mid portion in an opening direction of the weakly-sealed portion 4. The constituent resin of the package material 2*a* fluidized by the heat and pressure adhesion flows into this wide gap 42 to form a resin lump 39 at this position.

The foregoing resin lump is formed by fluidizing the substrate resin and the resin of the peelable layer which constitute the package material. The fluidization of the constituent resin differs depending on the kind of resin, heating temperature of the sealing means, pressure, gap between the sealing means, passing speed (pressurizing time) or the like sealing conditions. Accordingly, it is possible to form the resin lump at a predetermined position by sophisticatedly setting these sealing conditions. However, depending on the kind of resin, heating temperature, pressure, passing speed or the like, it is not easy to form the weakly-sealed portion and the resin lump by one heat and pressure adhesion operation during the process of continuously producing the packages.

On the other hand, the sixth aspect forms the wide gap at the position adjacent to the narrow gap between the sealing means and at least part of the further extension area from the mid portion in the opening direction of the weakly-sealed portion. Flowed into this wide gap is the constituent resin of the package material fluidized by the heat and pressure adhesion to thereby form the resin lump at this portion. This can easily form the weakly-sealed portion and the resin lump at predetermined positions through one heat and pressure adhesion operation by employing sealing means set to provide a gap therebetween depending on the shape of the product. In other words, the sixth aspect can easily form the resin lump at a predetermined position by using sealing means set to have a gap therebetween depending on the shape of the product. Therefore, even in the case of continuous processing, it can efficiently pack the object.

The resin lump can be formed by several applications of a heat and pressure adhesion operation, like an example case where another heat and pressure adhesion operation is applied to a predetermined portion of the further extension area from the mid portion in the opening direction after the weakly-sealed portion has been formed.

The sixth aspect generally adopts a pair of rolls, bars or the like for the sealing means. In order to adhere both package materials to each other with heat and under pressure through these means, normally the gap therebetween has to be at least smaller than the total thickness of both package materials. However, in many cases each sealing means has a surface provided with concave portions and convex portions like undulations of a file, which are engaged with one another. As for the sealing means of this type, the gap generally means a spacing between the trough of the concave portion and the peak of the convex portion Even if the spacing between the peak and the trough is larger than the total thickness of both package materials, both package materials can be adhered together under pressure through these sealing means by reducing a spacing between peaks of mutually engaged concave and convex portions in comparison with the total thickness of both package materials.

In the fourth to sixth aspects, the package materials forming the package are sufficient if at least one of them is a peelable sheet-like package material and therefore are not limited to those formed by laminating two sheet-like package materials one on another such as the conventional one. For example, they may be formed by hermetically sealing a peripheral edge of an opening of a cup-like container with a package sheet, or may take other package forms.

The package materials are satisfactory if at least one of them has either of its surfaces provided with a peelable layer. Therefore, the other package material is not limited to synthetic resin but may be an aluminum foil or the like metal material having one of its surfaces provided with a resin layer. Further, the other package material may have one of its surfaces provided with a peelable layer as well as the one package material.

As for the substrate resin of the constituent resin of the package material, thermoplastic synthetic resin such as, for example, polypropylene is employed. Thus it is a material which attains a high adhesion strength through heat adhesion to the other package material. On the other hand, the peelable layer is a material which readily causes a coagulant break, interface break, interlayer break or the like by a relatively weak force, although it adheres with heat to the other package material. Concrete examples are a resin material comprising polypropylene resin of a continuous phase, and polyethylene resin dispersed in this polypropylene resin, and the like.

Although the peelable layer may be formed only at a required portion of the package material, it is also possible to employ a peelable package material provided with the peelable layer over an entirety of one of its surfaces since it increases adhesion strength at predetermined portions by forming a resin lump in the further extension area from the mid portion in the opening direction or by heating the further extension area. This case is preferable since it need not precisely position the portion for accommodating the packed object with respect to the peelable package material and besides can attend to the packed objects of various shapes and sizes with one or a few kinds of package materials.

BRIEF DESCRIPTION OF THE DRAWINGS

FIG. 17 is a comparison chart showing results of Comparison Test 1 which compared peeling strength (adhesion strength) at a resin lump when sealing conditions were change.

FIG. 19 is a comparison chart showing results of Comparison Test 2 which compares peeling strength (adhesion strength) of a weakly-sealed portion with that of a resin lump when the heating temperature of the sealing means was changed.

FIG. 24 is a comparison chart showing results of Comparison Test 3 which compared peeling string (adhesion strength) at a weakly-sealed portion with that at a resin lump of a peelable package formed from preheated package sheets.

DETAILED DESCRIPTION OF THE INVENTION

Hereafter, embodiments of the present invention are explained based on the drawings.

Figures 1A, 1B:
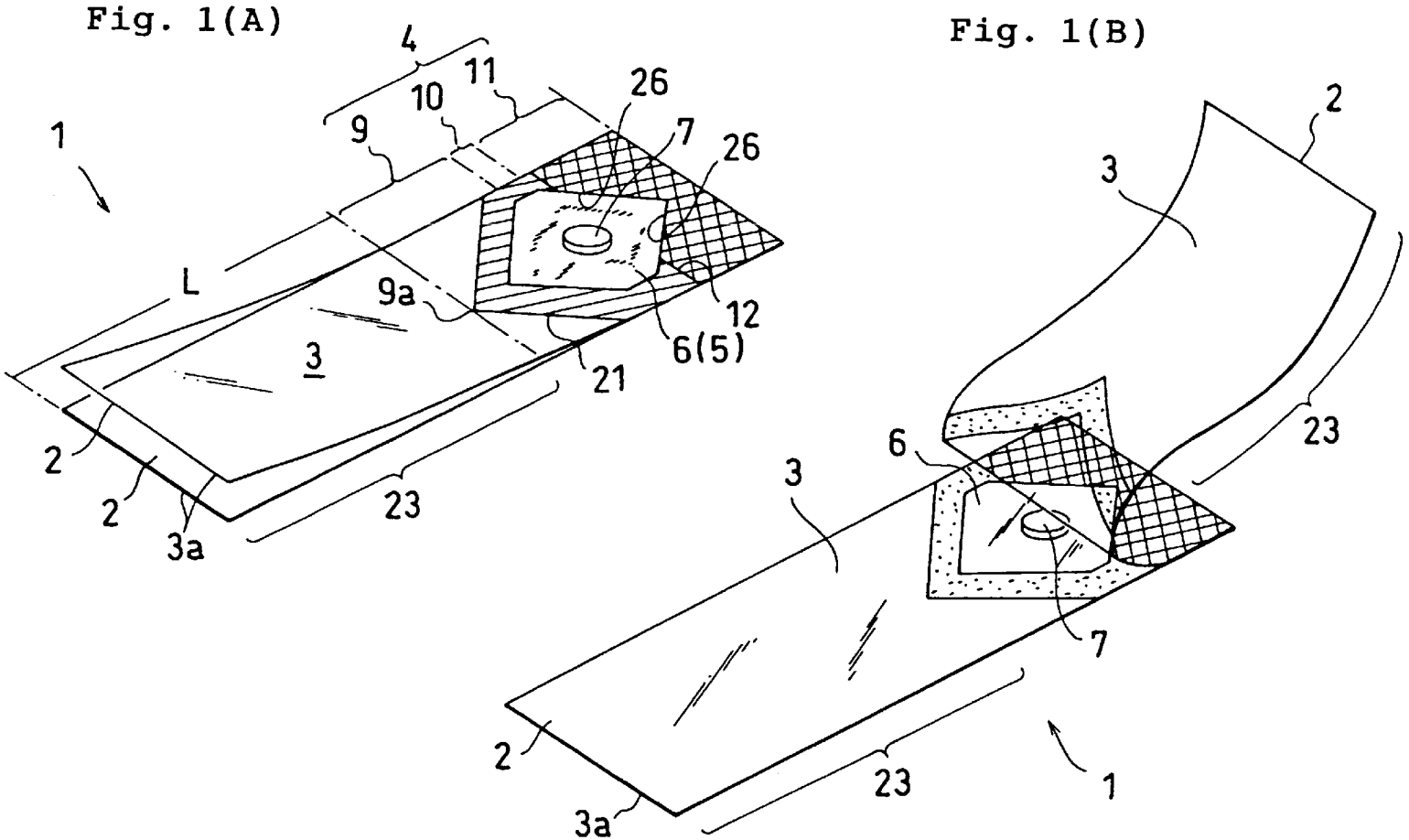
FIG. 1(A) is a perspective view of a medicine package.
FIG. 1(B) is a perspective view showing one example of the medicine package when it is in use.

FIG. 1 shows a medicine package as a first embodiment of the present invention. FIG. 1(A) is a perspective view of the medicine package, and FIG. 1(B) is a perspective view showing one example of the medicine package when it is in use.

The medicine package 1 sandwiches at least one tablet 7 between a pair of rectangular package sheets 2,2 and forms a weakly-sealed portion 4 so as to surround the tablet 7 while leaving a grip flap 3 for each of the sheets 2,2, thereby forming a bag portion 5 for accommodating the tablet 7.

This embodiment employs a sheet formed by laminating a peelable resin film on a transparent heat-resistant substrate film for the sheet-like package material 2. It is not always necessary to laminate the peelable resin film on both of the sheets 2. The peelable package 1 of the present invention can be formed if at least one of the sheets 2 includes the peelable resin film.

The heat-resistant substrate film is composed of, for example, cellophane, polyethylene terephthalate or the like. The peelable resin film is composed of, for example, 'TORAYFAN' (registered Trade Mark) CF9501 made by TORAY Plastic Films Co., Ltd.

The weakly-sealed portion 4 is formed while leaving a non-sealed hexagonal area 6 at one of the opposite ends of each of both rectangular sheets 2 and providing a sealed area outlined in the shape of a home base so as to surround the non-sealed area 6. The non-sealed area 6 corresponds to the bag portion 5.

The weakly-sealed portion 4 comprises a front V-shaped sealed portion 9, parallel sealed side portions 10 and a rear inverted V-shaped sealed portion 11 arranged in order from an opening side as shown in FIG. 1(A). The front V-shaped sealed portion 9 can smoothly start opening because the weakly-sealed portion 4 has an area reduced on its front side from which opening operation commences. The rear inverted V-shaped sealed portion 11 has two inclined sides 26,26 so that the sealed area becomes wider toward a rear part of the weakly-sealed portion 4. A rear end area of each sheet 2 behind the inclined sides 26,26 is sealed over its entirety.

A non-sealed area on the other end where the weakly-sealed portion 4 is not formed comprises as a grip flap 3. A length (L) between a front tip 9*a* of the front V-shape sealed portion 9 and an outer edge 3*a* of the grip flap 3 is set to at least 10 mm. If necessary, it is set to about 15 mm and preferably to about 20 mm. With an extra margin taken into consideration, it should be set to about 30 mm.

In the construction shown by FIG. 1, assuming that an extension line (not shown) is drawn from every point on a boundary line 21 between the weakly-sealed portion 4 and the grip flap 3, most of the grip flap 3 is occupied by an area 23 where each of the extension lines cut by the grip flap outer edge 3*a* has a length of at least 10 mm.

An optimum position of the rear inverted V-shape sealed portion 11, indicated by a dividing line 12 in FIG. 1(A), is set to have a sealing strength larger than those of the front V-shape sealed portion 9 and the parallel sealed portions 10. Due to this arrangement, a large force is suddenly required during the peeling process of the weakly-sealed portion 4. The optimum position indicated by the dividing line 12 may be provided not only at the rear inverted V-shaped sealed portion 11 but also in the area of the parallel sealed portions 10. As for the method of increasing the sealing strength from a predetermined position, it is possible to restrain the sealing strength of the weakly-sealed portion in front of the position indicated by the dividing line 12 through part-coating, or to increase an adhesion strength behind a predetermined position by changing the adhered area other than to form a resin lump at the weakly-sealed portion or to effect a partial heat treatment as mentioned later.

Next, how to open this medicine package is explained.

When a rheumatoid patient or the like person having handicapped fingers opens this medicine package 1, he can open it without dropping the tablet or the like by fixing the grip flap 3 of one package sheet 2 onto a plane such as a desk as shown in FIG. 1(B) with, for example, the thumb of his left hand while holding the grip flap 3 of the other package sheet 2 between side surfaces of the thumb and forefinger of his right hand to unseal it. In this case, since the grip flap 3 is set to have a large length as mentioned above, even the person having handicapped fingers can open the package easily.

Figure 2:
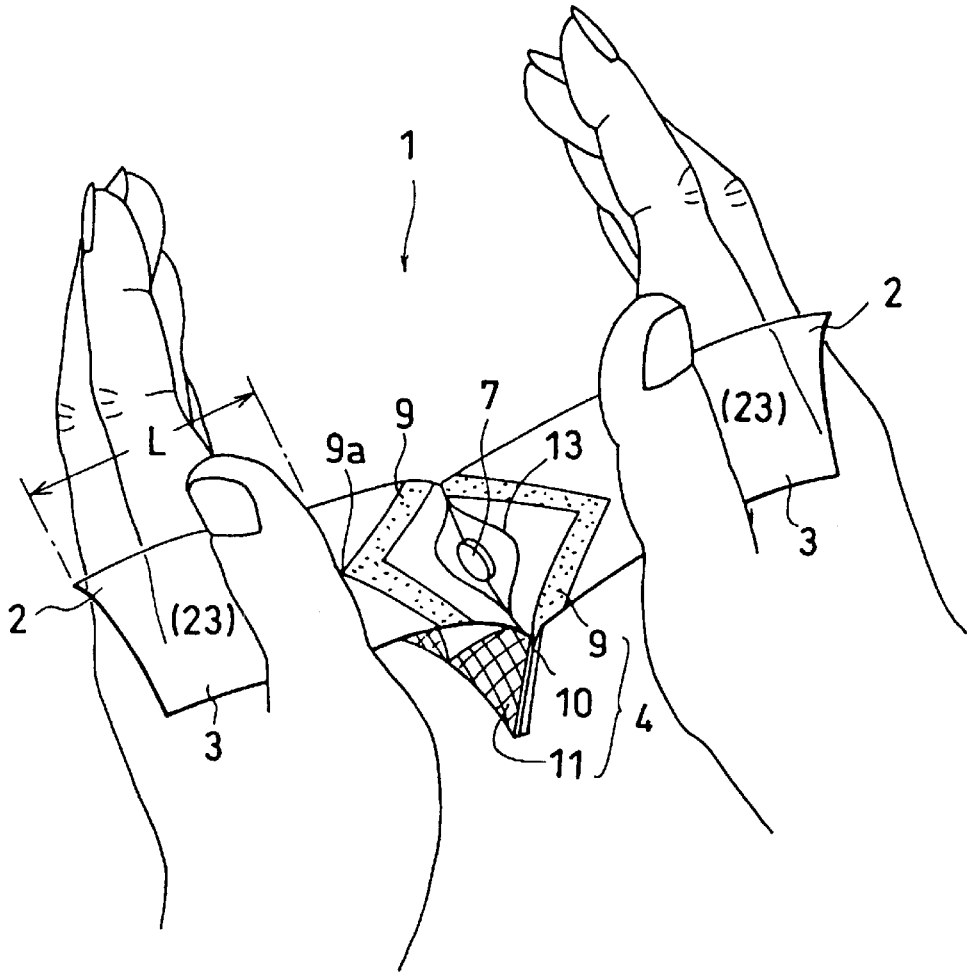
FIG. 2 is a perspective view for explaining one example of operation for opening the medicine package.

In the event that there is not any plane like a desk for putting the medicine package 1, as shown in FIG. 2 the grip flaps 3 of the respective sheets 2 are held between and fixed to side surfaces of the thumbs and forefingers of the right and left hands. When the both hands are widened in that state, the package is opened.

When conducting such an opening operation, for example, there is required between the front tip 9*a* of the front V-shape sealed portion 9, which is directed toward the opening side, and the end of the grip flap 3, at least such a length (L) that the side surfaces of the thumb and forefinger can hold it therebetween. Concretely, an adult has a thumb of about 20 mm in thickness. The thumb side surface contacts the forefinger side surface at a position which is about half the thickness of the thumb, namely at a position about 10 mm high from the palm. Therefore, if the grip flap 3 has a length of at least 10 mm, it is expected that the opening operation shown in FIG. 2 can be done. However, when taking it into consideration that the thumb width varies in size depending on the age and the race of people, it may be about 15 mm. Further, the sheets are held with the whole side surfaces of the thumbs more stably, so that about 20 mm may be more preferable. If an extra margin is taken into consideration, the length of about 30 mm can effect the opening operation more easily.

On the other hand, should the grip flap 3 be too long, there is a high probability that it twists or bends before opening the package. This makes the opening operation difficult. Therefore, it is better if the grip flap 3 has a length not more than 100 mm, preferably not more than 60 mm, and more preferably not more than 50 mm.

Hereafter, explanation is given for how the present embodiment is adapted so as to inhibit the jumping of the tablet.

Figure 3:
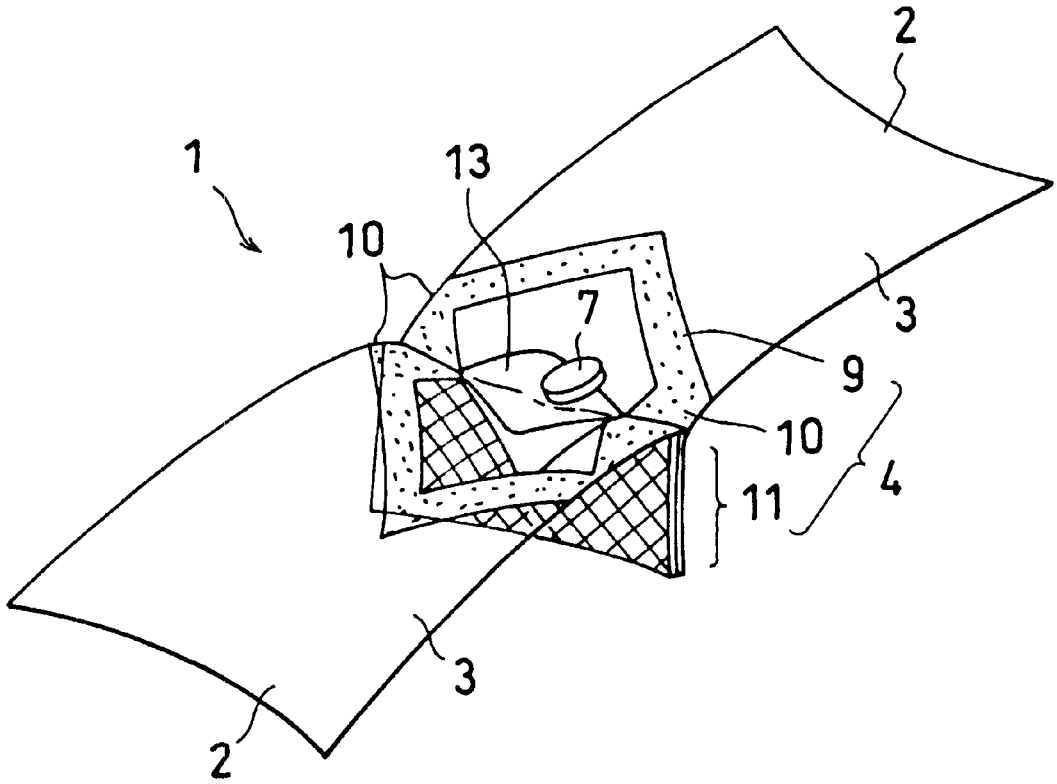
FIG. 3 is a perspective view for explaining a function of a cavity formed when opening the medicine package.

As shown in FIG. 2, when the pair of package sheets 2,2 are going to be opened, first the front V-shape sealed portion 9, next the parallel sealed portions 10, and finally the rear inverted V-shaped sealed portion 11 are opened in order. At this time, while the parallel sealed portions 10 and the rear inverted V-shaped sealed portion 11 are opened, there is formed a substantially conical cavity 13 as shown in FIG. 3. The formation of such a three-dimensional cavity 13 enables the sheets 2,2, to maintain a stable posture at a position where they are peeled off. The tablet 7 is inclined toward the cavity 13 to thereby restrain its movement. In consequence, even if the sheet 2 somewhat moves along with the opening operation, it reduces the probability that the tablet 7 jumps up and down.

The size and shape of the cavity when the sheets become most stable is selected by an experiment in accordance with the and number of the tablets 7, thereby determining the shape of the rear inverted V-shape sealed portion 11 so as to form such a cavity 13. The sealing strength of the weakly-sealed portion is increased at a position where the most stable cavity 13 is formed. Then the opening operation can be stopped surely at that position, which results in the possibility of taking out the tablet 7 readily.

In short, provided that the peeling strength is set to suddenly become large at the position indicated by the dividing line 12 as shown in FIG. 1, the opening operation can be assuredly stopped at the position where the most preferable cavity 13 is formed.

As shown in FIG. 3, the cavity 13 is formed so as to narrow toward its front end and is provided at a rear part position of the weakly-sealed portion 4. This can maintain the surfaces of the two sheets stable in such a state that most of the medicine package 1 is opened.

Figure 4A:
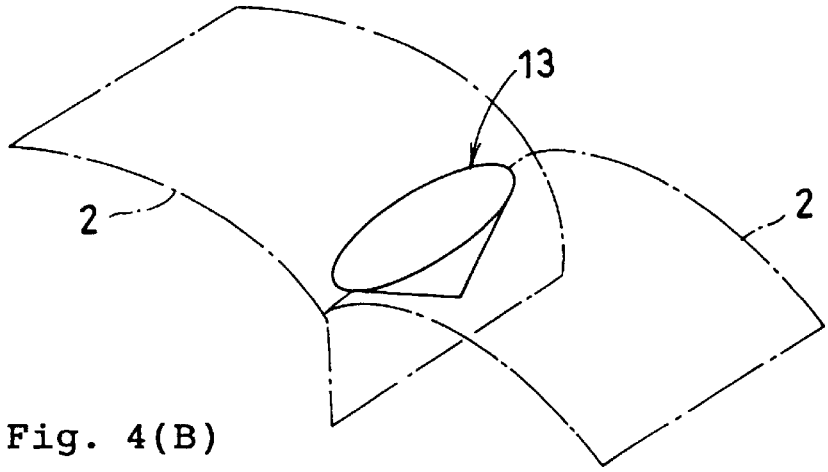
FIG. 4(A) explains a case where the cavity is formed in a shape similar to a shallow cone.
Figure 4B:
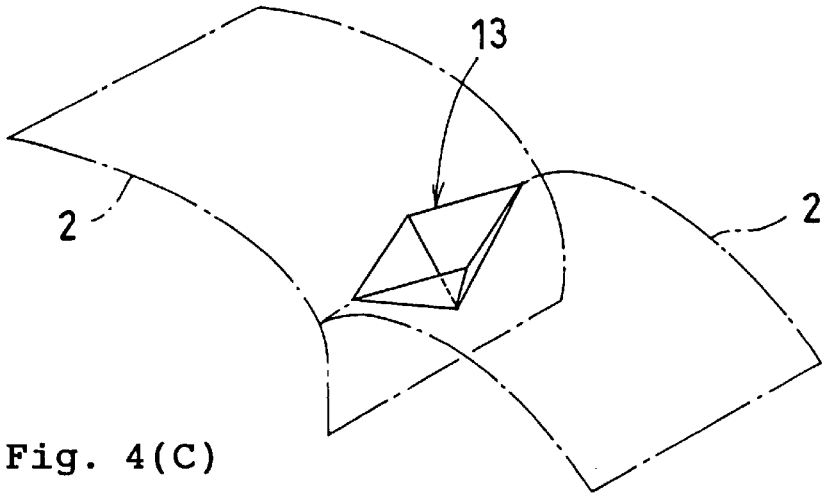
FIG. 4(B) explains a case where the cavity is formed in a shape similar to a shallow pyramid.
Figure 4C:
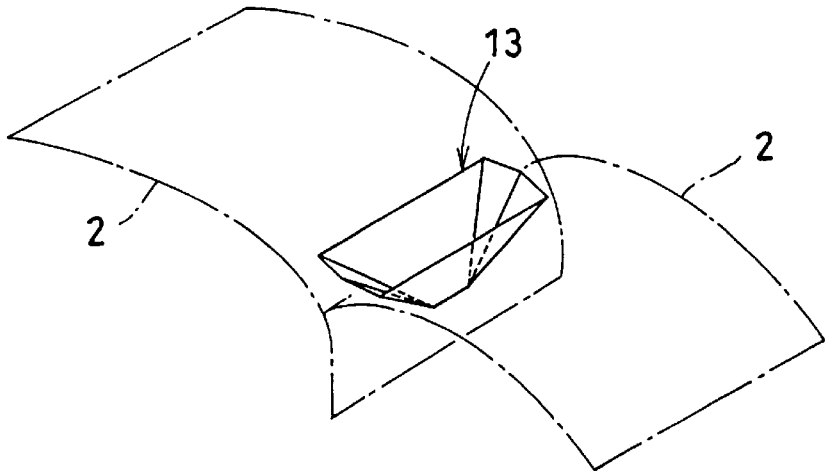
FIG. 4(C explains a case where the cavity is formed in a shape similar to a hip roof.

The shape of the cavity 13 is not limited to that illustrated in this embodiment. For example, various modifications as shown in FIG. 4 are considered for the cavity 13 narrowing toward its front end. FIGS. 4(A), 4(B) and 4(C) illustrate cases of forming the narrow cavity 13 like a shallow cone, a shallow pyramid and a hip roof, respectively.

FIG. 5 illustrates another modification of the first embodiment.

This modification does not adopt such a construction that the peeling strength is abruptly increased at the position indicated by the dividing line 12 as explained in the first embodiment. However, the weakly-sealed portion 4 has an area progressively increasing toward its rear part to thereby set the peeling strength of the rear inverted V-shaped sealed portion 11 larger than that of the parallel sealed portions. In addition, the non-sealed area 6 of the bag portion 5 containing the tablet 7 gradually narrows towards its rear end.

Figure 5A:
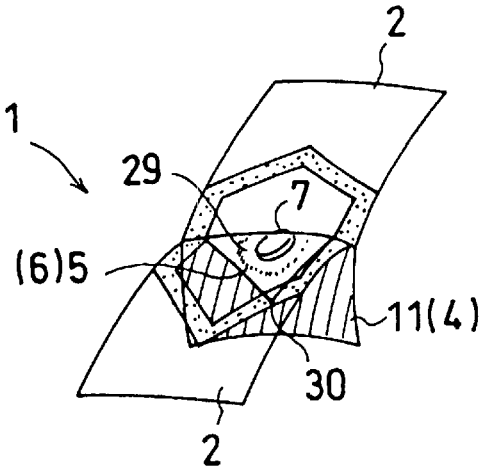
FIG. 5(A) is a perspective view of a medicine package while it is opening.
Figure 5B:
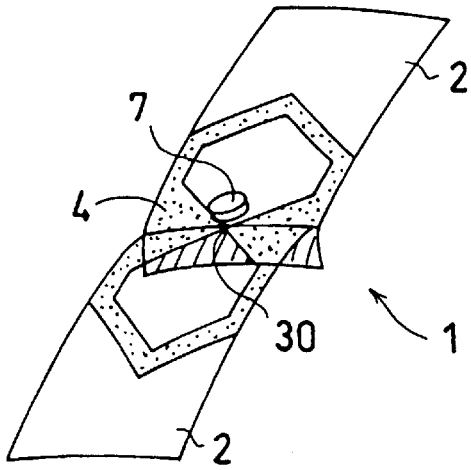
FIG. 5(B) is a perspective view showing a weakly-sealed portion opened up to the rearmost end.

The package sheet 2 has a horizontal bulge 29 because it contains the tablet 7 as shown in FIG. 5(A). However, the rear inverted V-shaped sealed portion 11 is gradually formed so as to narrow the non-sealed area 6 toward its rear end. Therefore, as the weakly-sealed portion 4 is peeled, the non-sealed area 6 where the tablet 7 freely moves in the bag portion 5 becomes gradually narrower. Accordingly, as shown in FIGS. 5(A) to 5(B), while the weakly-sealed portion 4 is peeled until it reaches a bottom point 30 of the V-shape, the bulge 29 of the sheet 2 gradually disappears to result in seldom causing such a phenomenon that the tablet 7 becomes unstable upon receipt of a force. Even if the weakly-sealed portion 4 is opened to its rearmost end as shown in FIG. 5(B), the tablet 7 can be inhibited from inadvertently jumping out during the opening process.

The rear inverted V-shaped sealed portion 11 of the weakly-sealed portion 4 requires a gradually-increasing force so as to be continuously peeled until it reaches the bottom point 30 of the V-shape because the weakly-sealed portion 4 progressively increases its area toward its rear part. This leads to a natural reduction of the peeling speed. In consequence, when the opening operation of the weakly-sealed portion 4 finishes, the sheets 2 move slowly enough to prevent the tablet 7 from inadvertently jumping out and take it out safely.

Figure 6:
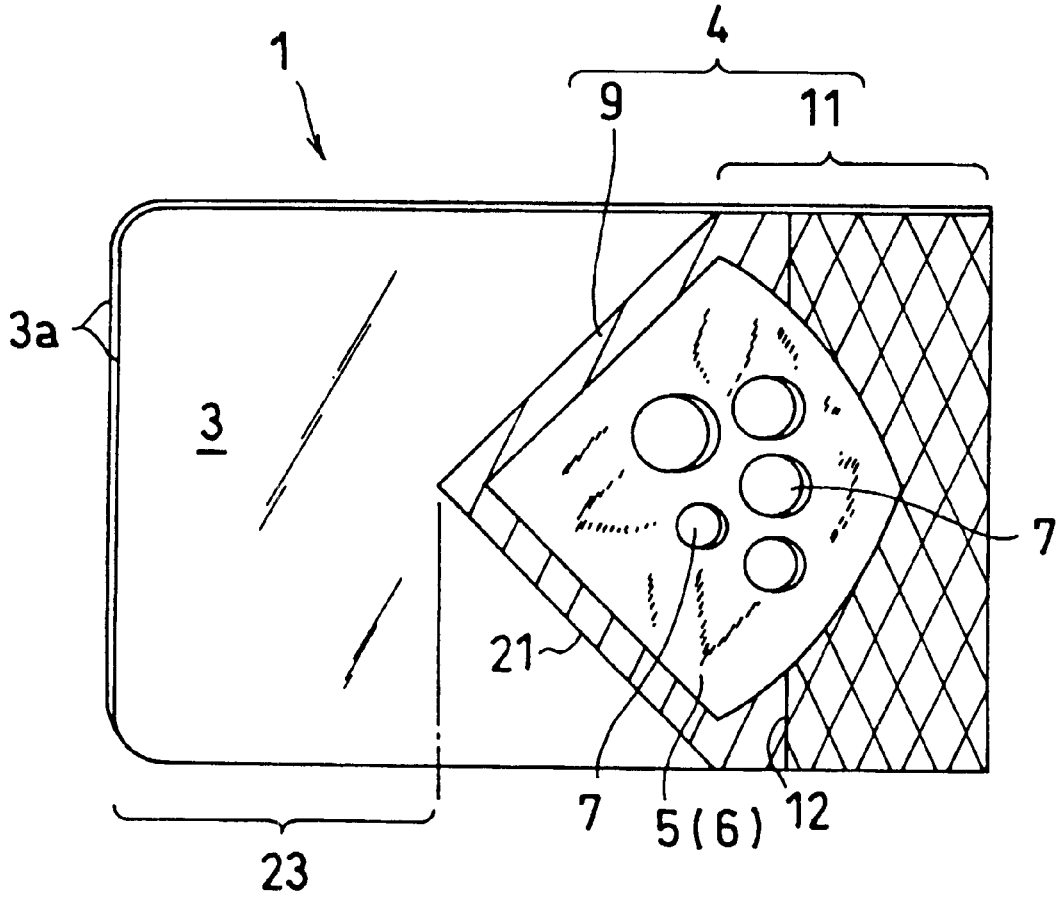
FIG. 6 is a front view of a medicine package showing a second embodiment of the present invention.

FIG. 6 is a front view of a medicine package showing a second embodiment of the present invention.

This second embodiment differs from the first embodiment in that the bag portion 5 has a volume increased so as to be able to accommodate about 5 to 8 tablets 7, and in that the non-sealed area 6 of the bag portion 5 is formed like a fan. In other words, this second embodiment does not form such parallel sealed portions 10 in the weakly-sealed portion 4 as those in the first embodiment. The front V-shaped sealed portion 9 connects directly with the rear inverted V-shape sealed portion 11. This embodiment also gradually narrows the non-sealed area 6 and progressively widens the rear inverted V-shaped sealed portion 11 toward the rear part of the bag portion 5 so as to form the same cavity 13 as formed in the first embodiment. The boundary between the rear inverted V-shaped sealed portion 11 and the non-sealed area 6 is curved. The bag portion 5 of the medicine package 1 as shown in FIG. 6 has an area of 25 cm2 at largest.

Figure 7B:
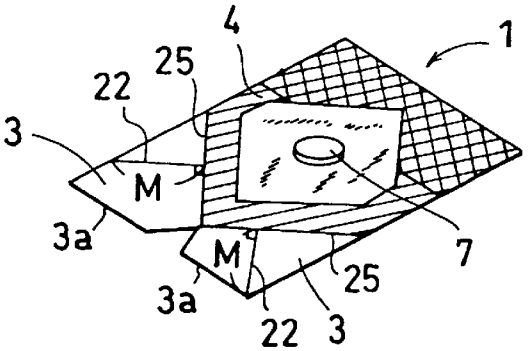
FIG. 7(B) is a perspective view of a medicine package showing a fourth embodiment.
Figure 7A:
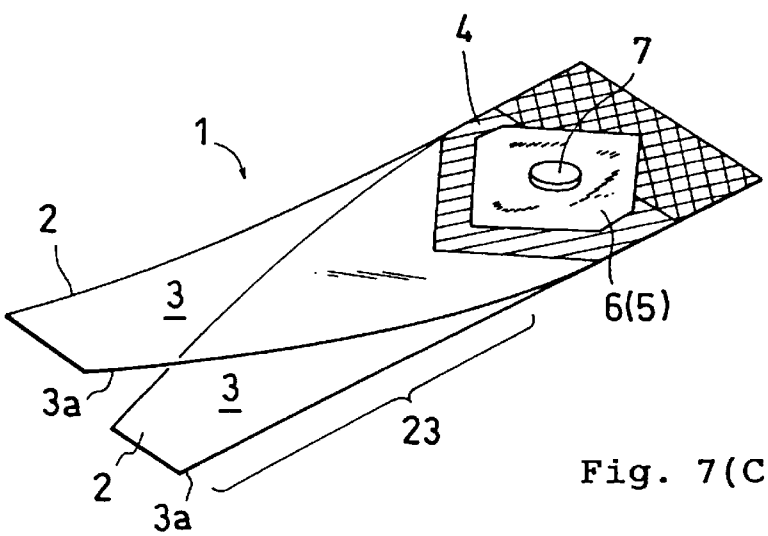
FIG. 7(A) is a perspective view of a medicine package showing a third embodiment.
Figure 7C:
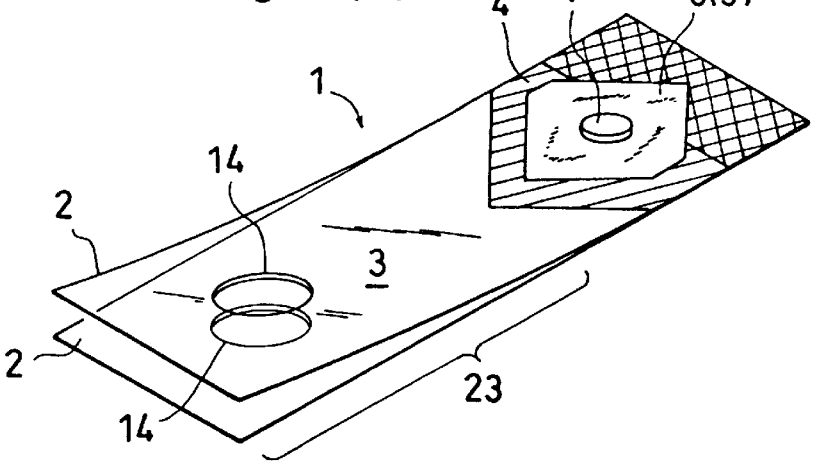
FIG. 7(C) is a perspective view of a medicine package showing a fifth embodiment.

FIG. 7 shows other embodiments of the present invention. FIG. 7(A) is a perspective view of a medicine package showing a third embodiment. FIG. 7(B) is a perspective view of a medicine package showing a fourth embodiment. FIG. 7(C) is a perspective view showing a fifth embodiment.

These third to fifth embodiments each modifies the grip flap 3 of the first embodiment. The third embodiment cuts out mutually opposing sides of the front regions of the grip flaps 3 of the respective sheets 2 so that the remaining parts of the grip flaps 3 are staggered with respect to each other in a left and right direction. The cut out sheets 2 make it easy to handle the respective grip flaps 3 when holding them between fingers. In other words, if the two sheets 2,2 exactly fit together with each other, it is difficult to separate the grip flaps 3 of the respective sheets 2 one by one and hold them between fingers. However, this third embodiment solves such a disadvantage. The fourth embodiment shown in FIG. 7(B) is the same as the third embodiment in that it cuts out the front regions of the respective grip flaps 3 so that they are staggered with each other in the left and right direction. However, the front V-shape sealed portion 9 has two oblique sides 25,25. Assuming that extension lines 22,22 are drawn from these sides 25,25, each of the grip flaps 3 is constructed so that it includes an area where each of the extension lines 22 is cut by the grip flap outer edge 3*a* to have a length (M) of at least 10 mm. Further, this fourth embodiment arranges the grip flaps 3 of the both sheets 2 so that they are not laid one on another entirely.

The fifth embodiment shown in FIG. 7(C) provides an opening 14 of a predetermined shape in each of the grip flaps 3. The two sheets 2 are easily handled by hooking the openings 14 with finger tips. Further, depending on the condition of the finger tips of the patient, the sheets 2 can be pulled with the finger tips passed through the openings.

Figure 8:
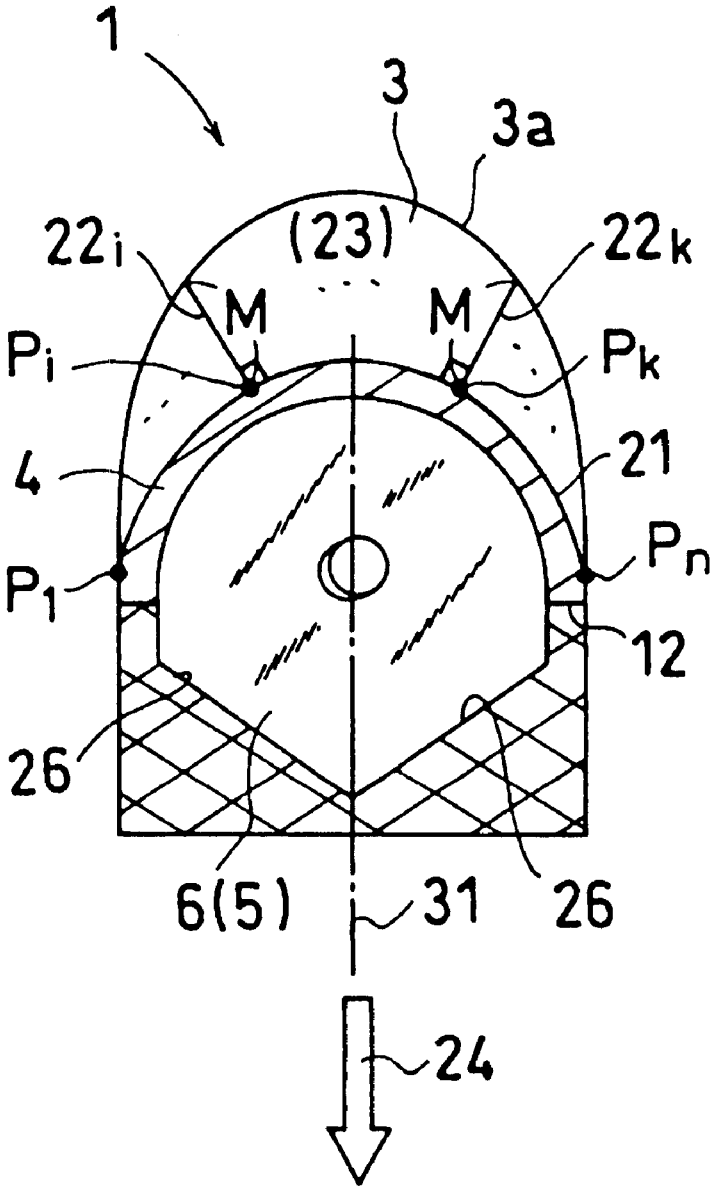
FIG. 8 is a front view of a medicine package showing a sixth embodiment.

FIG. 8 is a front view of a medicine package showing a sixth embodiment of the present invention. The peelable packages explained in the foregoing respective embodiments each includes a weakly-sealed portion having a front side formed in the shape of a letter 'V', and is constructed so that the weakly-sealed portion starts peeling with a small force. The weakly-sealed portion of the peelable package according to the present invention is not limited to this shape. This sixth embodiment forms the front side of the weakly-sealed portion 4 in the shape of a semicircle.

It further forms the grip flap outer edge 3*a* in the shape of a semicircle, as well. Assuming that extension lines are drawn perpendicular to a boundary line 21 between the weakly-sealed portion 4 and the grip flap 3 from points (P1) to (Pn) on the boundary line 21, the grip flap 3 is formed so as to include an area 23 where the vertical lines 22*i* to 22*k* are each cut between the points (Pi) to (Pk) and the grip flap outer edge 3*a* to each have a length (M) of at least 10 mm. The area 23 of this grip flap 3 is arranged upstream of a preliminarily imagined opening direction 24 of the weakly-sealed portion 4 so as to be able to effect the opening operation easily.

The weakly-sealed portion 4 is formed in the shape of a letter 'V' comprising two sides 26 inclined with respect to the opening direction 24 so that the non-sealed area 6 gradually narrows toward the rear part of the bag portion 5. The bag portion 5 has a center line 31 coincident with the opening direction 24. The weakly-sealed portion 4 is formed symmetrical in a left and right direction with respect to the center line 31. Thus the rear part of the weakly-sealed portion 4 is peeled in the same state on its left and right sides when unsealing the weakly-sealed portion 4 to thereby make the sheet surfaces stable.

Figure 9:
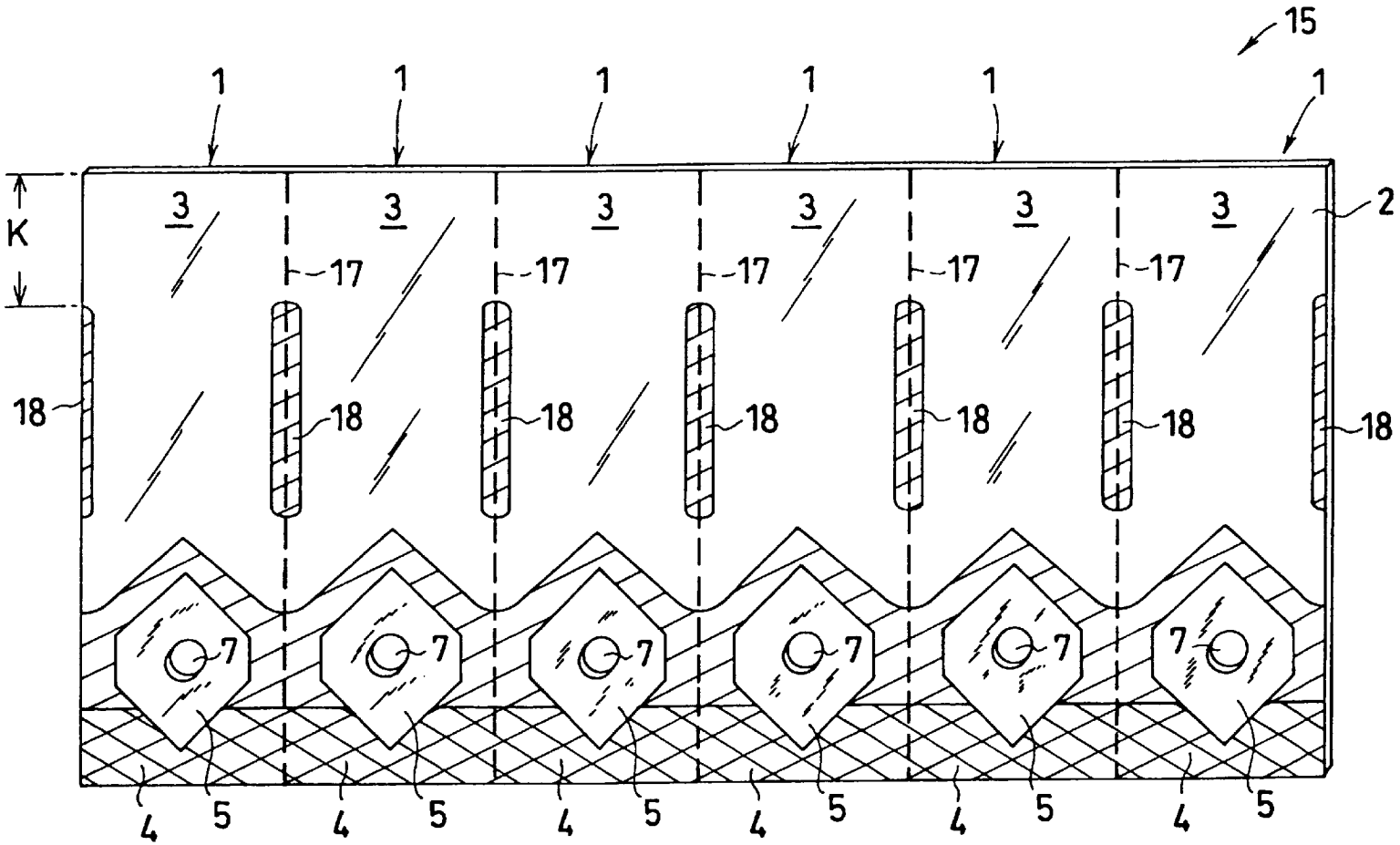
FIG. 9 is a front view of connected packages showing a seventh embodiment of the present invention

FIG. 9 is a front view of connected packages for explaining a seventh embodiment of the present invention.

The seventh embodiment comprises a plurality of peelable packages 1 such as shown in FIG. 1, connected to one another. The weakly-sealed portion 4 of each peelable package 1 is formed in substantially the same manner as in the first embodiment.

The connected packages 15 comprise two package sheets 2 which sandwich a plurality of tablets 7 therebetween and form a plurality of bag portions 5 by providing weakly-sealed portions 4 so as to surround the respective tablets 7 while leaving an area which comes to a grip flap 3 for each of the sheets. Either of the sheets 2 is formed with cut lines 17 so as to independently cut and separate the respective peelable packages 1, each of which comprises a bag portion 5 and a grip flap 3 for the bag portion 5. Anti-peeling sealed portions 18 are formed along the cut lines 17 within the grip flaps 3 of the peelable packages As such, formation of the anti-peeling sealed portions 18 along the cut lines 17 facilitate to form the cut lines 17 during the production of the connected packages 15. Perforations are generally adopted for the cut lines 17. The perforations are formed after the weakly-sealed portion 4 has been formed. Therefore, if the anti-peeling sealed portion 18 is formed, it does not move the portion which comes to the grip flap 3 and as a result makes it easy to form the perforations.

Further, it produces an advantage of being able to inhibit the grip flaps 3 from bending or twisting while the connected type of packages 15 are stocked, if the anti-peeling sealed portions 18 are formed in the grip flaps 3 of the connected type of packages 15.

Additionally, a length (K) between a front end of the grip flap 3 of each peelable package 1 and the anti-peeling sealed portion 18 is preferably set to a length, for example, of at least 10 mm so that even a person having handicapped fingers can open the anti-peeling sealed portion 18. Besides, the anti-peeling sealed portion 18 is preferably set to have a weak sealing strength. In a state where the anti-peeling sealed portions 18 are further unsealed after the respective packages 1 have been cut and separated by resorting to the cut lines 17, each peelable package 1 has substantially the same whole structure as that shown in FIG. 1.

Figure 10:
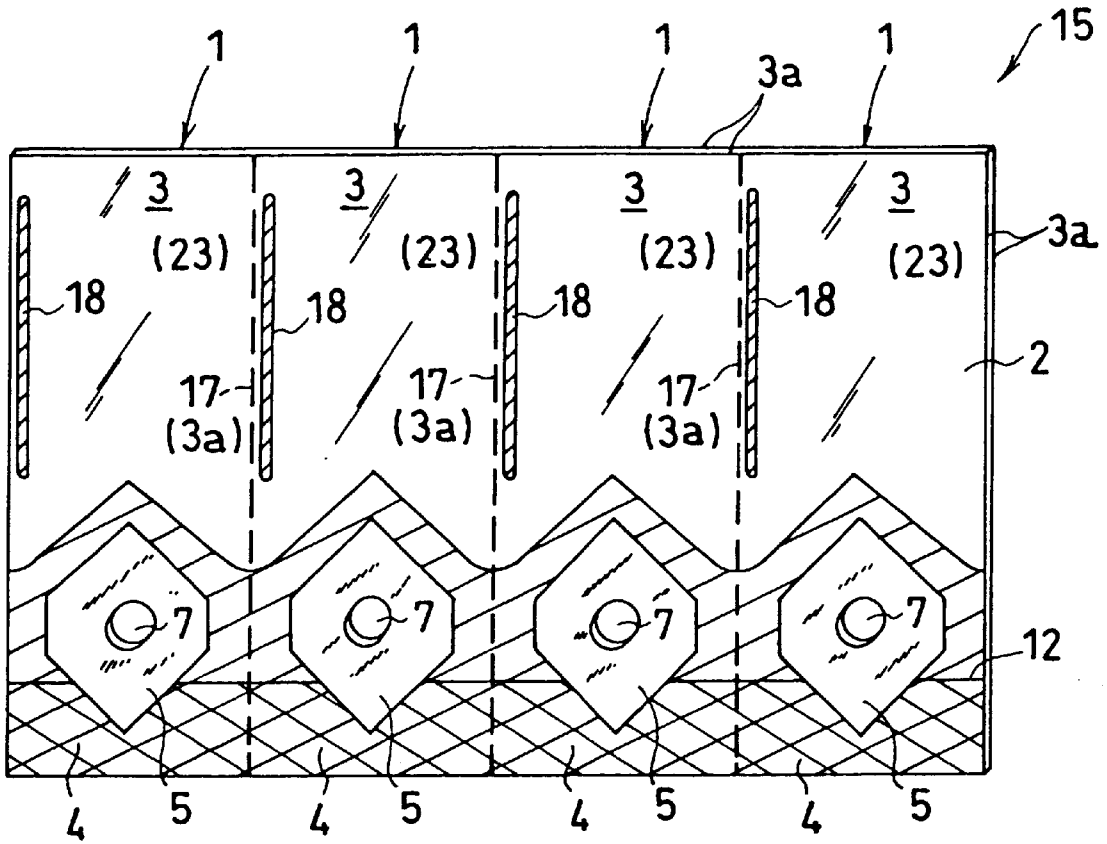
FIG. 10 is a front view of connected packages showing an eighth embodiment.

FIG. 10 is a front view of a connected type of packages for explaining an eighth embodiment of the present invention.

When compared with the seventh embodiment, the eighth embodiment is characterized in that the anti-peeling sealed portion 18 is provided on only one side of each cut line 17, and that each of the peelable packages 1 cut and separated along the cut lines can be opened by picking up an area 23 aside the anti-peeling sealed portion 18. This embodiment also presents an effect of inhibiting the movement of the portion of the sheet which comes to the grip flap 3. It further dispenses with a necessity of providing the length (K) between the front end of the grip flap 3 of the peelable package 1 and the anti-peeling sealed portion 18, for example, such as shown in FIG. 9. This can make the package more compact.

Figure 11:
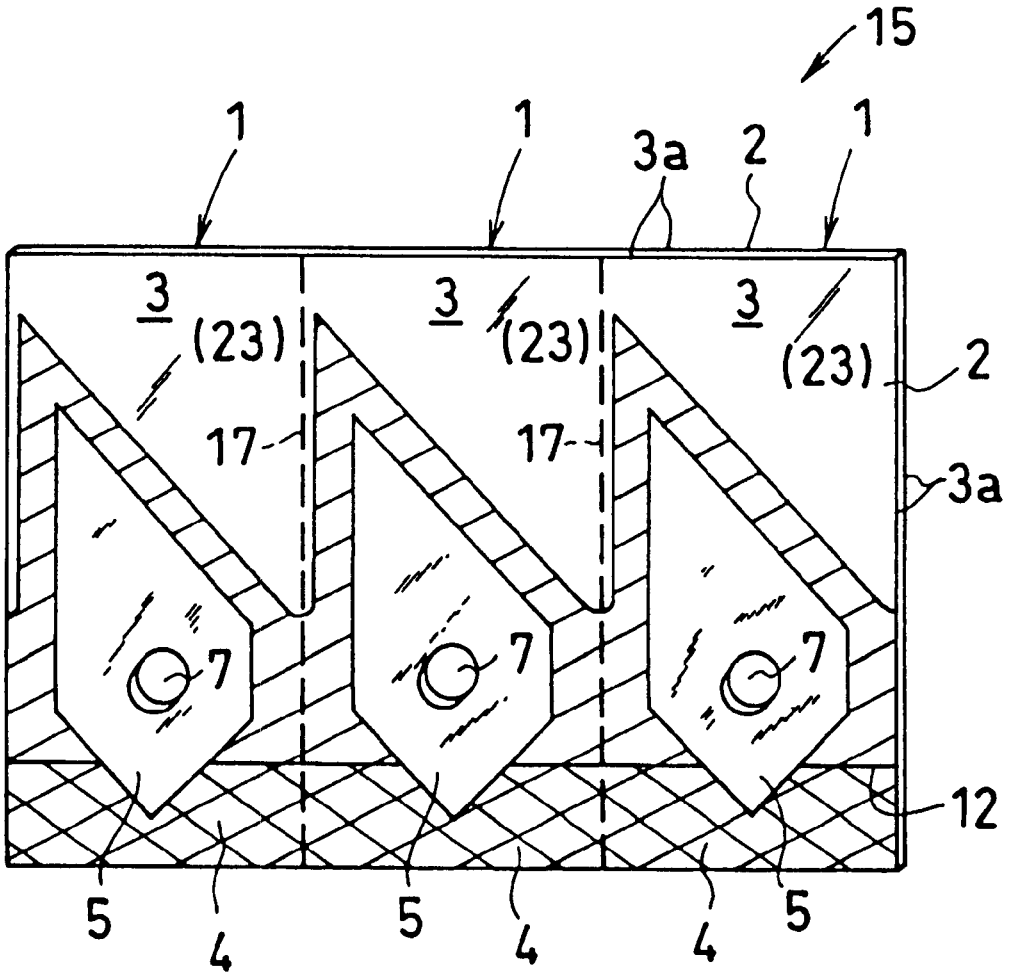
FIG. 11 is a front view of connected packages showing a ninth embodiment.

FIG. 11 is a front view of connected packages for explaining a ninth embodiment.

The ninth embodiment is the same as the seventh and eighth embodiments in that the respective peelable packages 1 are made separably from the connected packages 15 by using the cut lines 17. However, it is characterized in that the weakly-sealed portion 4 on the opening side, which forms the bag portion 5, extends along the cut line 17 so that part of the weakly-sealed portion can also serve as the anti-peeling sealed portion.

The ninth embodiment facilitates the formation of the cut line 17 and enables the weakly-sealed portion 4 on the opening side, which forms the bag portion 5, to serve also as the anti-peeling sealed portion. This dispenses with the trouble of providing the anti-peeling sealed portion. Further, the construction as shown in FIG. 11 makes it possible to open the package by grasping a triangular grip flap 3. This produces an advantage of being able to shorten the entire length of each peelable package 1 as well as the construction as shown in FIG. 10.

Figure 12:
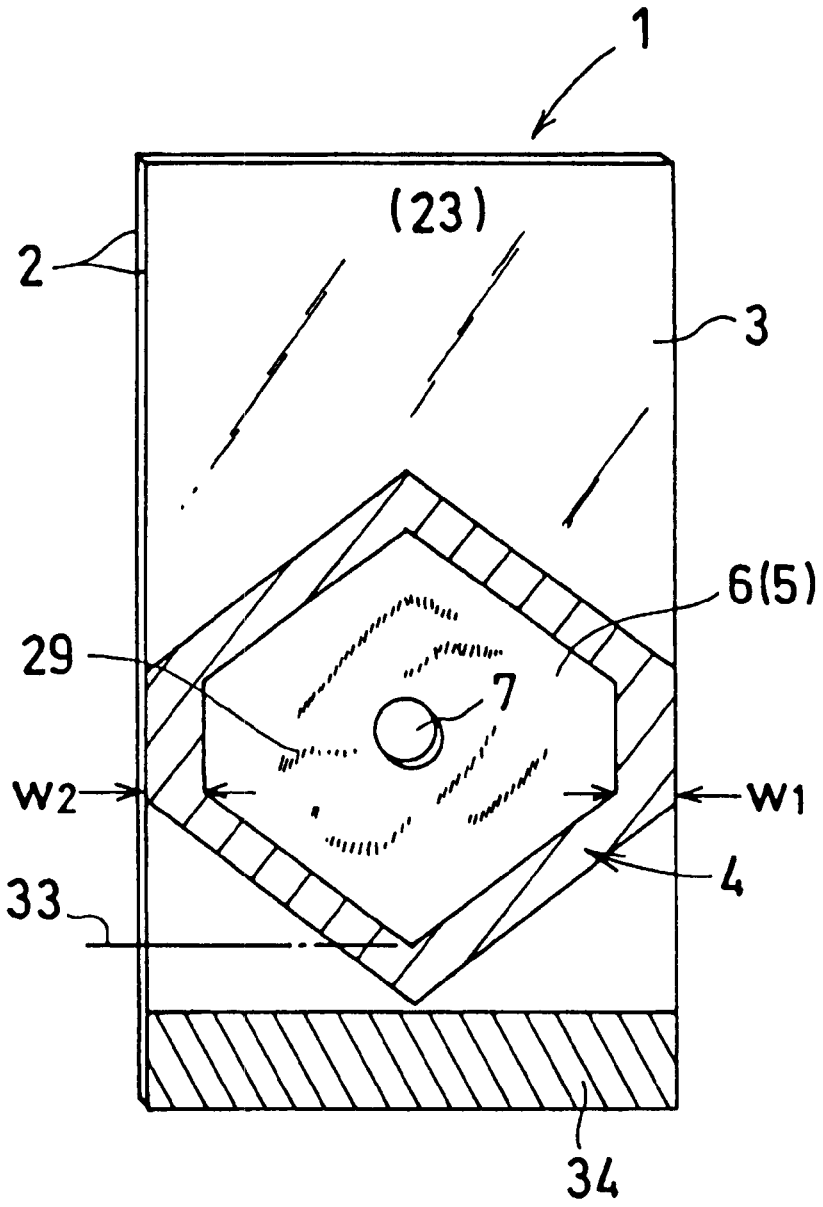
FIG. 12 is a front view of a medicine package showing a tenth embodiment of the present invention.
Figure 13A:
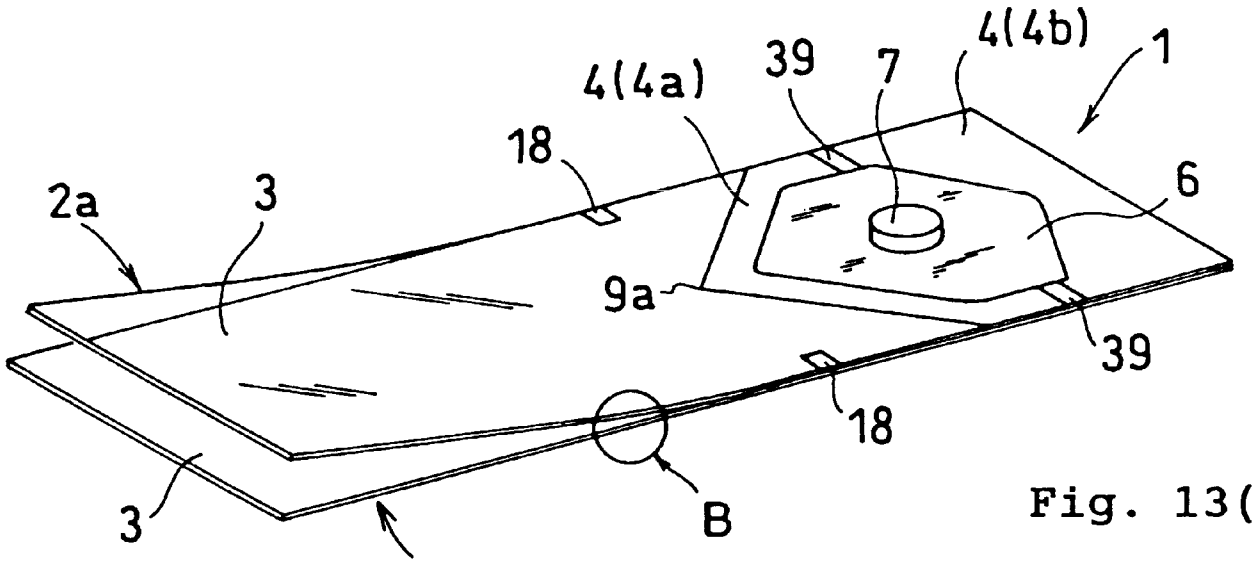
FIG. 13(A) is a perspective view of a peelable package.
Figure 13B:
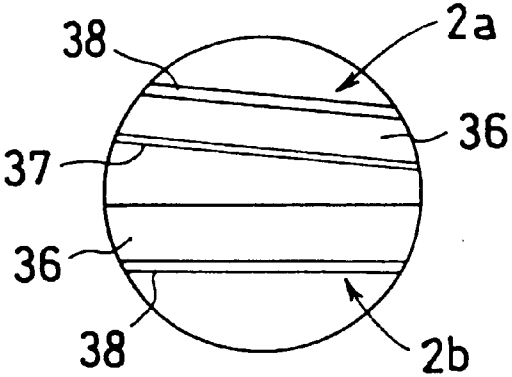
FIG. 13(B) is an enlarged view of a portion (B) of FIG. 13(A).

FIG. 12 is a front view of a medicine package for explaining a tenth embodiment of the present invention.

As shown in FIG. 12, as compared to the first embodiment, the tenth embodiment forms the weakly-sealed portion 4 so that it does not increase its area at the rear part of the bag portion 5. More specifically, in this tenth embodiment, the weakly-sealed portion 4 has a width (W=W1+W2) constant at its rear part. And there is formed an anti-separation sealed portion 34 in the shape of a horizontal strip behind a position 33 where the bag portion 5 is fully opened.

Although the weakly-sealed portion 4 is isolated from the anti-separation sealed portion 34 in this tenth embodiment, they may be in continuity with each other, if needed. While the weakly-sealed portion 4 is provided to construct the bag portion 5, the anti-separation sealed portion 34 is provided not to separate the two sheets 2,2 from one another after the bag portion 5 has been fully opened.

This construction hardly produces an effect of progressively delaying the opening speed as the package is opened. However, it can inhibit the tablet 7 from becoming unstable while the bulges 29 of the sheets 2,2, are disappearing since the weakly-sealed portion 4 is so formed that the non-sealed area 6 gradually narrows toward the rear part of the bag portion 5.

Each of the above-mentioned embodiments uses a rectangular sheet as a basic shape of the sheet, but they may adopt various other shapes such as a circular shape, an elliptic shape or the like one. The seventh, eighth and ninth embodiments have each exemplified parallel cut lines for those of the connected type of packages. Apparently, if the independent package varies its outline, the shape of the cut line changes depending on the varied outline. In addition, as for the method of preventing the pair of sheets from so exactly fitting with each other as to be hardly peeled off, it is possible to adopt methods of providing a pleat line at an end of one of the sheets to reversely turn it, bending the respective ends of the both sheets outwardly, making one of the sheets shorter than the other and the like properly, depending on the necessity, other than the construction shown in FIG. 7.

Figure 14:
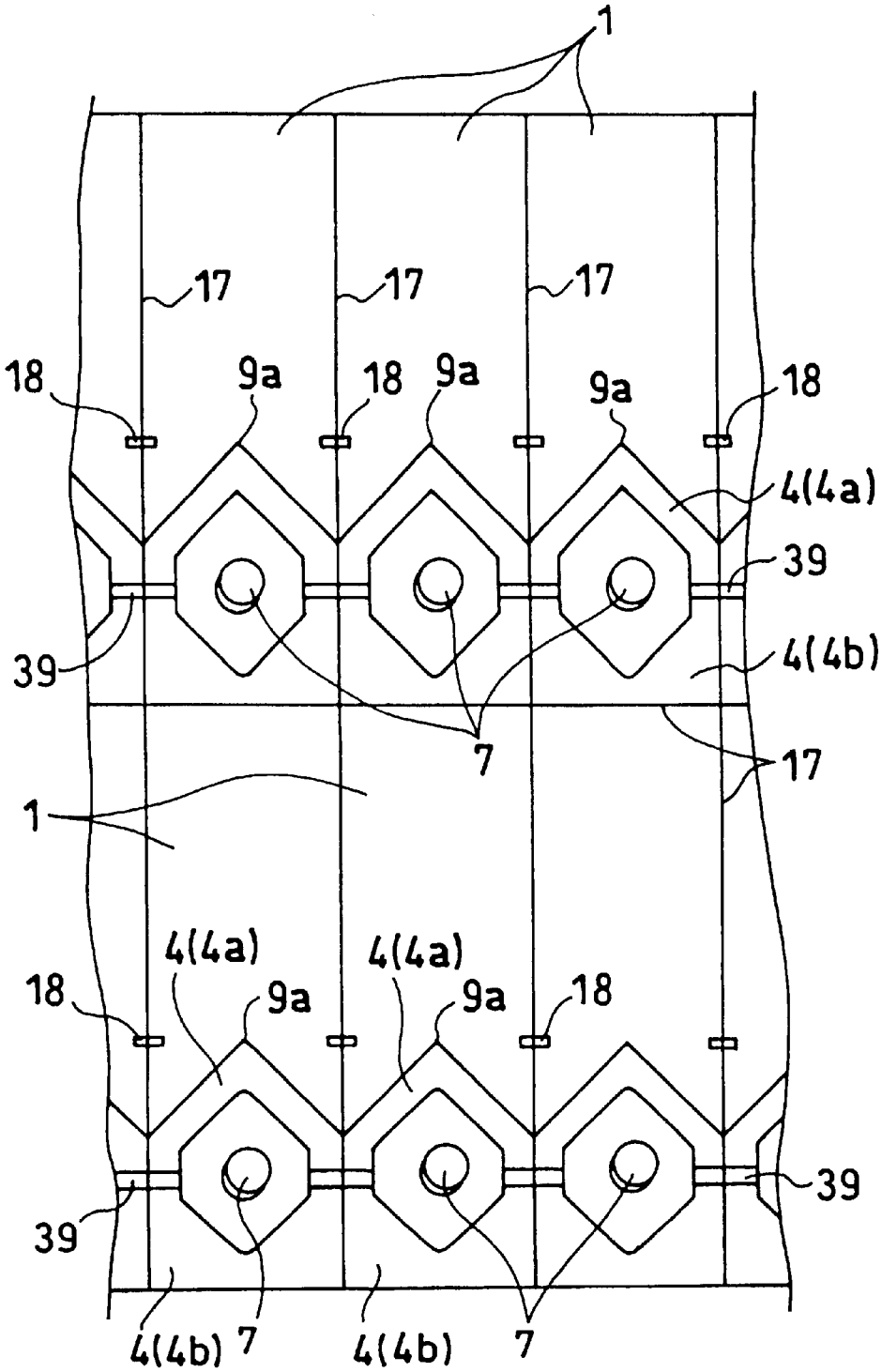
FIG. 14 is a front view of peelable packages showing a connected state.
Figure 15:
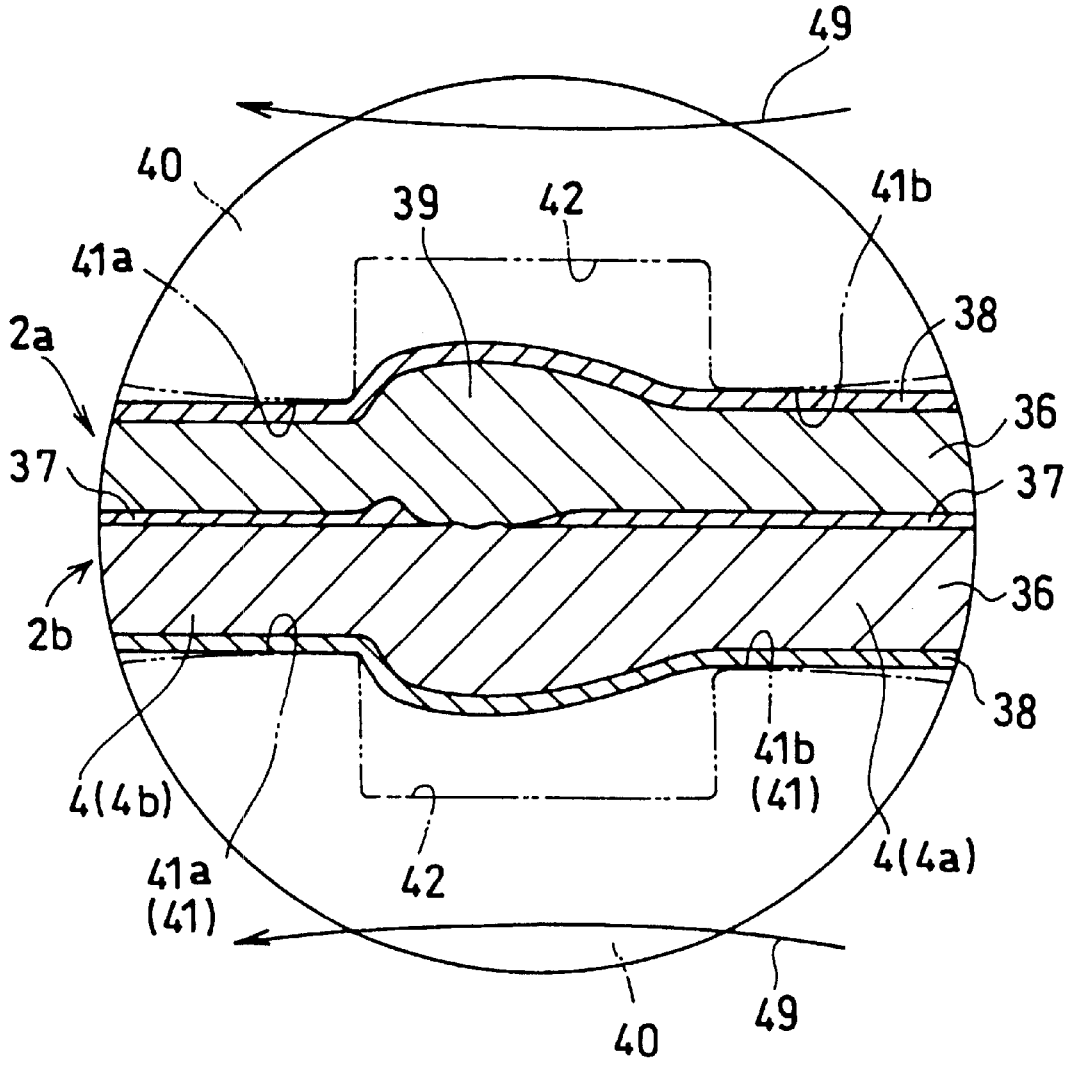
FIG. 15 is an imaginary enlarged view of the neighborhood of a resin lump in section.
Figure 16:
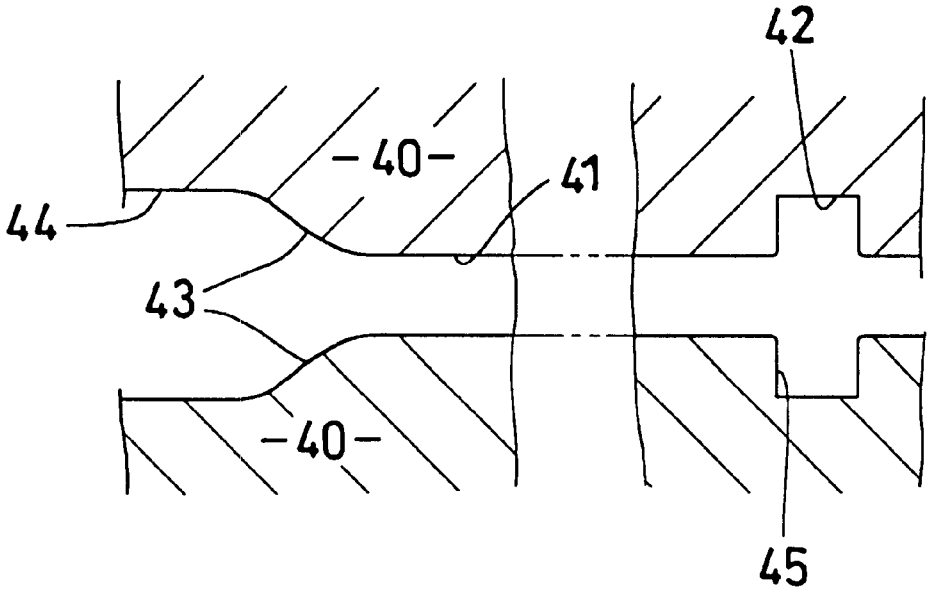
FIG. 16 explains a modification of a gap between sealing members.

FIG. 13 to FIG. 17 illustrate an eleventh embodiment of the present invention. FIG. 13(A) is a perspective view of a peelable package. FIG. 13(B) is an enlarged view of a portion (B) of FIG. 13(A). FIG. 14 is a front view of peelable packages showing a connected state thereof. FIG. 15 is an imaginary enlarged view of the neighborhood of a resin lump in section. FIG. 16 is an explanatory view showing a modification of a gap between sealing means. FIG. 17 is a comparison chart showing results of Comparison Test 1 which compared the peeling strengths (bond strengths) at a resin lump obtained under changed sealing conditions.

As shown in FIG. 13, the peelable package 1 comprises two rectangular sheets 2*a*,2*b* overlaid one on another. One of the package sheets 2*a* is formed from a substrate resin layer 36 of polypropylene resin which has an inner surface laminated with a peelable layer 37, and an outer surface adhered to a heat-resistant film 38 such as cellophane, polyethylene terephthalate resin and the like. The other package sheet 2*b* is also formed from the substrate resin layer 36 of polypropylene resin, which has the heat-resistant film 38 adhered only to its outer surface.

The sheets 2*a*,2*b* have a tablet 7, an object to be packed, arranged therebetween. The one sheet 2*a* has its peelable layer 37 adhered with heat and under pressure to the other sheet 2*b*, thereby forming a weakly-sealed portion 4 so as to surround the tablet 7 while leaving grip flaps 3,3 at the ends of the sheets 2*a*,2*b*. The size of the grip flap 3 is properly set depending on the necessity as in the first embodiment.

The weakly-sealed portion 4 has its outline formed in the shape of a home base so as to surround a hexagonal non-sealed area 6. A front tip 9*a* of a V-shape of the home base faces the grip flap 3 side from which the opening commences.

The weakly-sealed portion 4 comprises a front half portion 4*a* and a rear half portion 4*b*. A resin lump 39 is formed between the front half portion 4*a* and the rear half portion 4*b* and at a position adjacent to them by fluidizing part of the constituent resin of the package material such as the substrate resin and the peelable layer resin through the heat and pressure adhesion and collecting the fluidized part. This embodiment produces a resin lump only at one position in the opening direction. But the resin lump may be provided at plural positions.

As shown in FIG. 14, the peelable package 1 is ordinarily provided as plural ones connected in the left and right direction as well as in the front and rear direction. The cut lines 17 formed between the respective peelable packages 1,1 are broken to separate them into independent peelable packages 1. However, it is possible to form the packages independently or to connect them in series with each other from the beginning.

Numeral 18 indicates an anti-peeling sealed portion to protect the front tip 9*a* of the V-shape of the weakly-sealed portion 4 from being inadvertently opened while the package is being stored, or the like.

It is presumed that the peelable layer 37 is disturbed to break the layered state so that it comes to such a state as shown in FIG. 15 at the resin lump 39 when the resin of the substrate resin layer 36 is fluidized through the heat and pressure adhesion and is collected. As a result, the substrate resin of both package sheets 2*a*,2*b*, directly adhere to each other, thereby increasing the adhesion strength at this position much more than that of the weakly-sealed portion 4.

Next, how to produce the peelable package 1 is explained.

A tablet 7 is sandwiched at a predetermined position between the sheets 2*a*,2*b* and is passed through a pair of sealing means 40,40 such as die rolls, which are heated to a predetermined temperature.

A gap between the sealing means 40,40 is narrowed at a predetermined position with respect to a total thickness of the both sheets 2*a*,2*b*. Both sheets are passed through the narrow gap 41 to adhere the peelable layer 37 of the one sheet 2*a* to the substrate resin layer 36 of the other sheet 2*b* with heat and under pressure, thereby forming a weakly-sealed portion 4 around the tablet 7.

The narrow gap 41 between both sealing means 40,40 comprises a first pressure adhesion portion 41*a* and a second pressure adhesion portion 41*b*. A mid portion therebetween is abruptly widened to form a gap 42 wider than the total thickness of both sheets 2*a*,2*b* as shown by an imaginary line in FIG. 15.

This eleventh embodiment sets a rotation direction 49 of the sealing means 40 so as to pass both sheets 2*a*,2*b* between the sealing means 40,40 from their rear end sides, namely their right end sides shown in FIG. 13. In consequence, the first pressure adhesion portion 41*a* and the second pressure adhesion portion 41*b* correspond to the rear half portion 4*b* and the front half portion 4*a* of the weakly-sealed portion 4, respectively.

The first pressure adhesion portion 41*a* of the narrow gap 41 is formed narrower than the second pressure adhesion portion 41*b*. The resin of the substrate resin layer 36 is heated and pressurized at the first pressure adhesion portion 41*a* through the sealing means 40 to have its part fluidized, which flows out into the wide gap 42 to thereby form a resin lump 39. At this time, the peelable layer 37 is disturbed by the fluidization of the substrate resin to break its layered state. As a result, the substrate resin of both sheets 2*a*,2*b* directly adheres to each other at this resin lump 39 through the disturbed portion of the peelable layer 37. This enormously increases the adhesion strength at this position.

On the other hand, the gap at the second pressure adhesion portion 41*b* is narrow enough to adhere the sheets 2*a*,2*b* to each other, but is wider than that at the first pressure adhesion portion 41*a*. As a result, the resin of the substrate resin layer 36 and the peelable layer 37 is fluidized in a lesser amount at the first half portion 4*a* of the weakly-sealed portion 4 heated and pressurized at the second pressure adhesion portion 41*b*. This hardly forms a resin lump on the grip flap 3 side of the weakly-sealed portion 4, namely the front end side from which the opening starts to result in the possibility of readily opening the front half portion 4*a*.

The gaps 41,42 between the sealing means 40,40 largely influence the peeling strength (adhesion strength) of the weakly-sealed portion and that of the resin lump. Therefore, it is preferable to secure a predetermined gap between the sealing means while applying a high pressure by the sealing means, for example, through sophisticatedly controlling a limiter disposed on the sealing means or providing a projection of a predetermined height on a peripheral surface of one die roll to bring a front end of this projection into contact with the other die roll.

The eleventh embodiment differentiates the gap of the first pressure adhesion portion from that of the second adhesion portion and uniformly forms the gap at each of the pressure adhesion portions. But it is sufficient if at least part of the pressure adhesion portion is narrow enough to be able to form the resin lump. For instance, it is probable to incline either or both of the pressure adhesion portions so that they gradually narrow toward a predetermined position where a resin lump will be formed, in order to form the resin lump only at the predetermined position.

Further, even if the gap of the whole pressure adhesion portion is so narrow that the substrate resin can be readily fluidized, for example, as shown in FIG. 16, the narrow gap 41 formed between the pair of sealing means 40,40 has a front end side 43 in the opening direction moderately chamfered to be smoothly connected to a wide gap 44. A resin lump side 45 at a rear end is abruptly widened to be connected to the wide gap 42, thereby being able to directly adhere the substrate resin of the resin lump to the other package material only at the rear end side of a predetermined position.

When constructed as such, at the front end side 43, the substrate resin flows in a layered fashion to maintain the layered state of the peelable layer even if it is fluidized and therefore provides so weak a peeling strength as to facilitate the peeling when the package is opened. On the other hand, since the narrow gap 41 of the pressure adhesion portion is abruptly widened at the resin lump side 45 of the rear end, when the substrate resin flows into this wide gap 42, the peelable layer is disturbed to break the layered state, thereby directly adhering the substrate resin to the other package material to result in providing a high adhesion strength.

The fluidization of the substrate resin differs depending on the kind of substrate resin, heating temperature of the sealing means, pressure, gap between the sealing means, passing speed (pressurizing time) or the like.

However, generally, a high temperature close to a melting point of the substrate resin is preferable. For example, as for polypropylene resin, about 150 to 160 degrees C are preferable. Further, as regards the gap between the sealing means, the narrower, the more preferable.

FIG. 17 shows results of Comparison Test 1 obtained by comparing the peeling strength (adhesion strength) at a resin lump of each of the peelable packages produced through changing the gap between the sealing means and the heating temperature thereof.

One of the used package sheets comprises a peelable film made by forming a peelable layer on one surface of polypropylene resin and having a thickness of 40 $\mu$m, and polyethylene terephthalate resin of 12 $\mu$m in thickness adhered to the peelable film. The other comprises polypropylene resin film of 40 $\mu$m thickness and polyethylene terephthalate resin of 12 $\mu$m thickness adhered thereto. As for a comparison example, either of the sheets comprises polypropylene resin film of 40 $\mu$m thickness and polyethylene terephthalate resin of 12 $\mu$m thickness adhered thereto.

Each of the sealing means has concave and convex portions on its surface. Accordingly, the gap between the sealing means indicates an assumed length between the respective peak and trough of a convex portion and a concave portion. These sealing means are pressurized with a force of 7 kg/cm2. The package sheets were passed between the sealing means at a speed of 13 m/min.

Apparently from the results of Comparison Test 1, in the case where the sealing temperature was low or the sealing means defined a wide gap, the resin lump provided only a peeling strength as weak as that of the weakly-sealed portion. However, in the case where the sealing temperature was increased and the sealing means defined a narrow gap, it provided an adhesion strength far larger than that of the weakly-sealed portion.

Next, how to open the peelable package is explained.

Similarly as shown in FIG. 2 of the first embodiment, the respective grip flaps 3,3 of the both package sheets 2*a*,2*b* are held and fixed between the thumb and the forefinger of a right hand as well as between those of a left hand. In this state, the package is opened by widening a spacing between the both hands. When the opening position reaches the resin lump 39, the opening resistance is abruptly increased to thereby prevent further opening. At this time, a cavity 13 in the shape of a substantially square pyramid is formed around the tablet 7. The tablet 7 is maintained stable within this cavity 13 and therefore is unlikely to inadvertently jump out of the peelable package 1. In this state, a person places his mouth opposite to the opened portion of the peelable package 1 to carry the tablet 7 into his mouth by using his tongue tip and lip, or faces upward with his mouth opposed to the opened portion to make the tablet 7 fall from the peelable package 1 directly into his mouth. Accordingly, there is no need for receiving the tablet 7 with the hand or picking it up with the finger tips. This is sanitary and enables the person to dose himself with the tablet 7 safely and assuredly.

The resin lump 39 is formed by abruptly widening the gap between the sealing means 40,40. There is a fear that a short gap 42 cannot flow the substrate resin therein to sufficiently and on the other hand, an excessively long gap 42 produces a non-sealed portion. As for an optimum length of the gap, although it differs depending on the package materials and the sealing conditions, for example, about 0.5 to 1.5 mm is preferable in the case of the package sheet used for the above-mentioned Test of the peeling strength.

In the eleventh embodiment an explanation was given for the case where the peelable layer was disturbed at the resin lump so as to break the layered state, thereby adhering the substrate resin directly to the other package material with the result of enhancing the adhesion strength at the resin lump. However, according to the present invention, it is satisfactory if the adhesion strength of the resin lump is higher than that of the weakly-sealed portion. The layered state of the peelable layer need not always break.

Figure 18A:
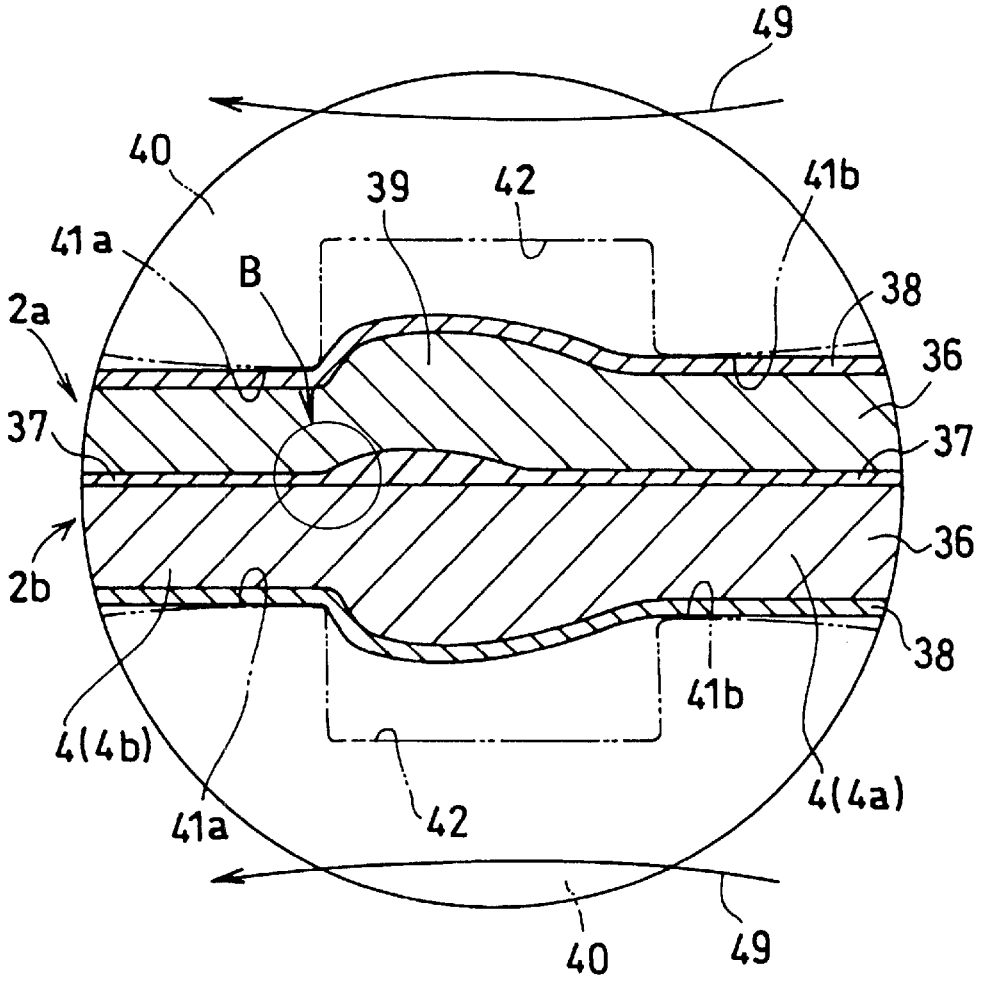
FIG. 18(A) is an enlarged sectional view of the neighborhood of a resin lump.
Figure 18B:
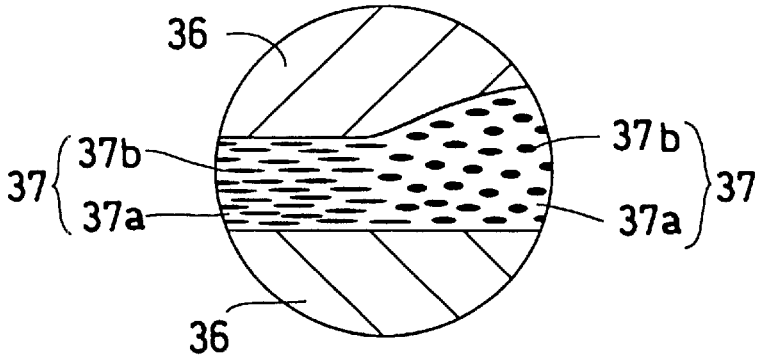
FIG. 18(B) is an enlarged view of a portion (B) of FIG. 18(A).

FIG. 18 shows a modification of the eleventh embodiment. FIG. 18(A) is an enlarged sectional view of the neighborhood of the resin lump. FIG. 18(B) is an enlarged view of a portion (B) of FIG. 18(A).

In this modification, the peelable layer 37 maintains its layered state even if the constituent resin of the package material is fluidized and collected to form the resin lump 39 as well as in the eleventh embodiment, and it is presumed to come to such a state as shown in FIG. 18(A).

The peelable layer 37 comprises first resin 37*a* such as polypropylene resin forming a continuous phase and second resin 37*b* such as polyethylene resin dispersed in the first resin 37*a*. As shown in FIG. 18(B), at the weakly-sealed portion 4, the second resin particles 37*b* are formed flat in a direction along the peelable layer 37. The interface area between the first resin 37*a* and each second resin particle 37*b* is wide and the interspacing between the second resin particles 37*b* is narrow.

On the other hand, at the resin lump 39, when the resin is fluidized by the heating, the second resin particles 37*b* tend to deform into more stable spheres. This decreases the interface between the first resin 37*a* and each second resin particle 37*b* and increases the interspacing between the second resin particles 37*b*.

As a result, both package sheets 2*a*,2*b* are peeled and separated from each other at the weakly-sealed portion 4 with a weak force, but at the resin lump 39 they have an adhesion strength far larger than that at the weakly-sealed portion 4.

A search was made as to the relationship between the change of the dispersed phase in the peelable layer and the readiness for the resin to be fluidized.

More specifically, as to peelable packages produced by changing the heating temperature of the sealing means, Comparison Test 2 compared the peeling strength (adhesion strength) at the weakly-sealed portion with that at the resin lump. FIG. 19 shows the obtained results.

Similarly with the Comparison Test 1, one of the used sheets comprises a peelable film of 40 $\mu$m thickness formed from polypropylene resin which has a peelable layer on one of its surfaces and polyethylene terephthalate resin of 12 $\mu$m thickness adhered to the peelable film. The other comprises polypropylene resin film of 40 $\mu$m thickness and polyethylene terephthalate resin of 12 $\mu$m thickness adhered thereto.

The sealing means was pressurized with a force of 5 kg/cm2. The package sheets were pressurized for 1.5 seconds between the sealing means.

Apparently from the results of this Comparison Test 2, at a lower sealing temperature the adhesion strength of the resin lump was not much larger than that of the weakly-sealed portion, but at an increased sealing temperature the adhesion strength of the resin lump was far larger than that of the weakly-sealed portion. It is considered this is because as the sealing temperature increases, the resin is fluidized better to result in readily deforming the dispersed phase in the peelable layer.

In the eleventh embodiment, the resin lump 39 is formed substantially perpendicular to the opening direction and is elongated over the entire width of the weakly-sealed portion 4. This can clearly enhance the opening resistance at the resin lump 39 and therefore can assuredly stop the opening operation at this position.

Figure 20:
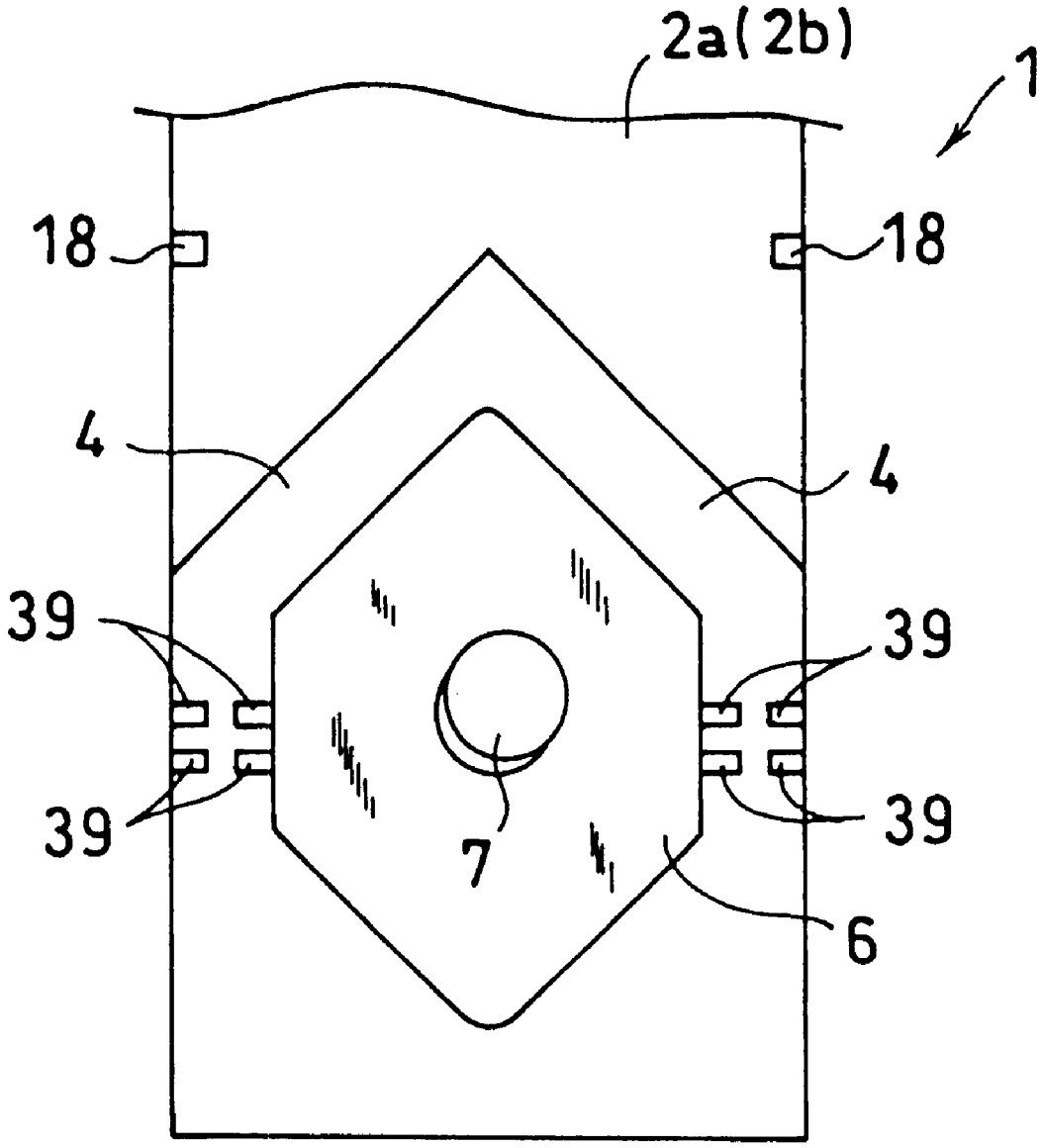
FIG. 20 is a partial front view of a peelable package showing a twelfth embodiment of the present invention.

In the twelfth embodiment shown in FIG. 20, the resin lump 39 is formed on opposite sides except the middle portion with respect to a width wise direction of the weakly-sealed portion 4. This enables the weakly-sealed portion 4 to surround the non-sealed area 6 which accommodates the tablet 7 without interrupting its surroundings and therefore hermetically seal it with assuredness.

This twelfth embodiment provides the resin lump at two portions on each of the opposite sides in the opening direction. It may be provided at one or at least three portions as well as in the eleventh embodiment.

Figure 21:
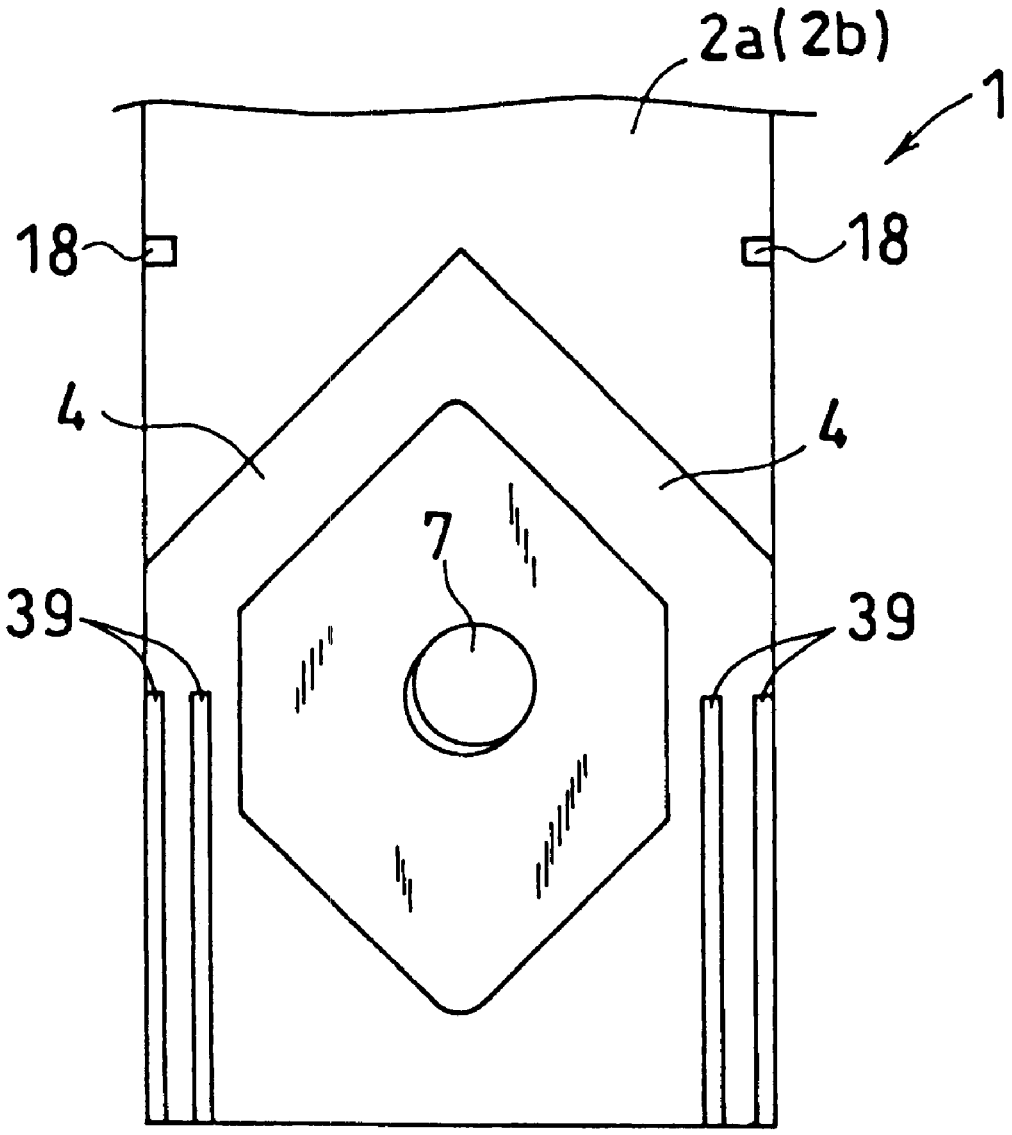
FIG. 21 is a partial front view of a peelable package showing a thirteenth embodiment.

In a thirteenth embodiment as shown in FIG. 21, the resin lump 39 is elongated along the opening direction. This narrows the adhesion width of the resin lump provided at one portion with respect to the opening direction and causes the resin lump 39 to peel off if the opening force is strong. Therefore, in some cases, there is a likelihood of partly breaking the package sheets 2*a*, 2*b*. Then in order to prevent this likelihood, the thirteenth embodiment provides the resin lump 39 at a plurality of portions in parallel with the opening direction so as to surely stop the opening at those portions.

Figure 22:
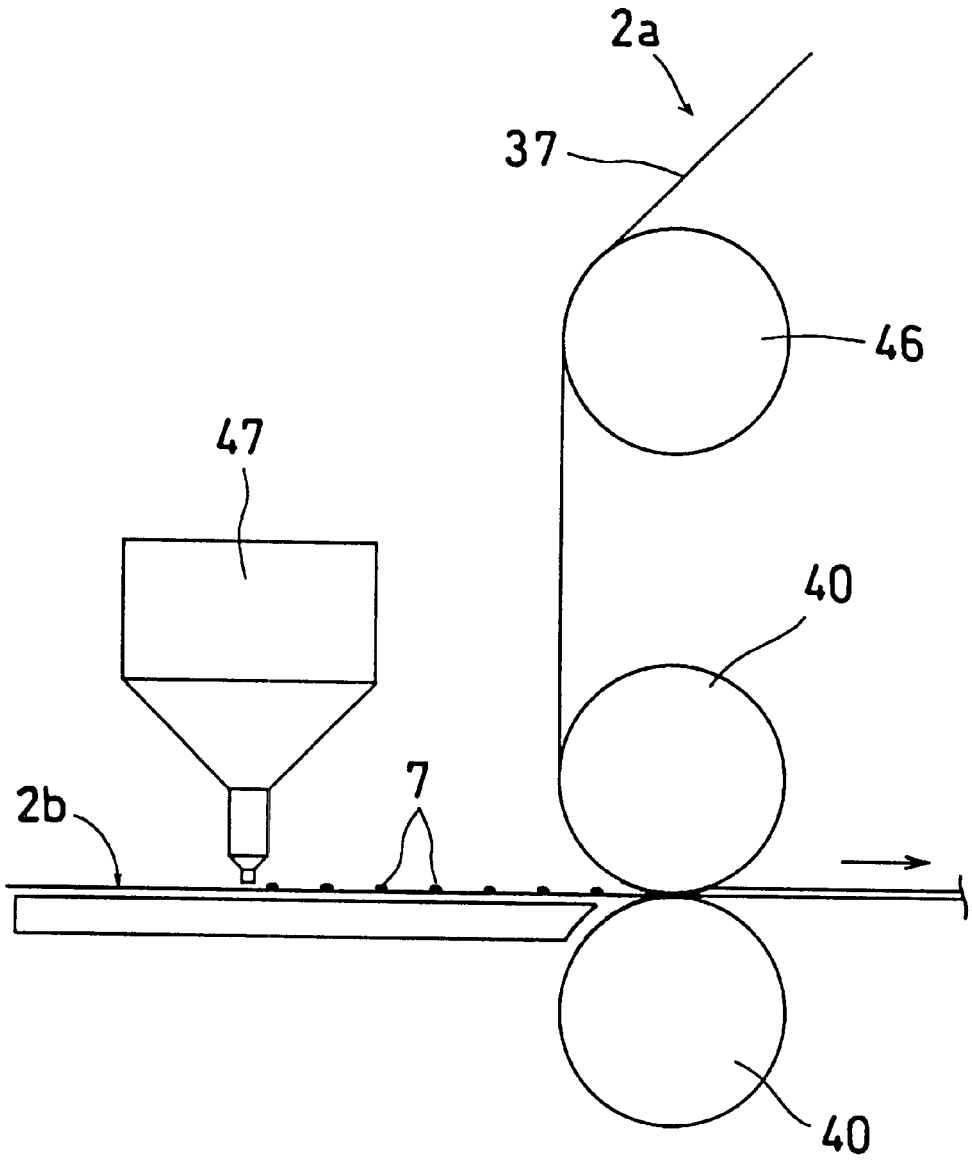
FIG. 22 is a schematic structural view of a packaging apparatus for producing peelable packages.
Figure 23:
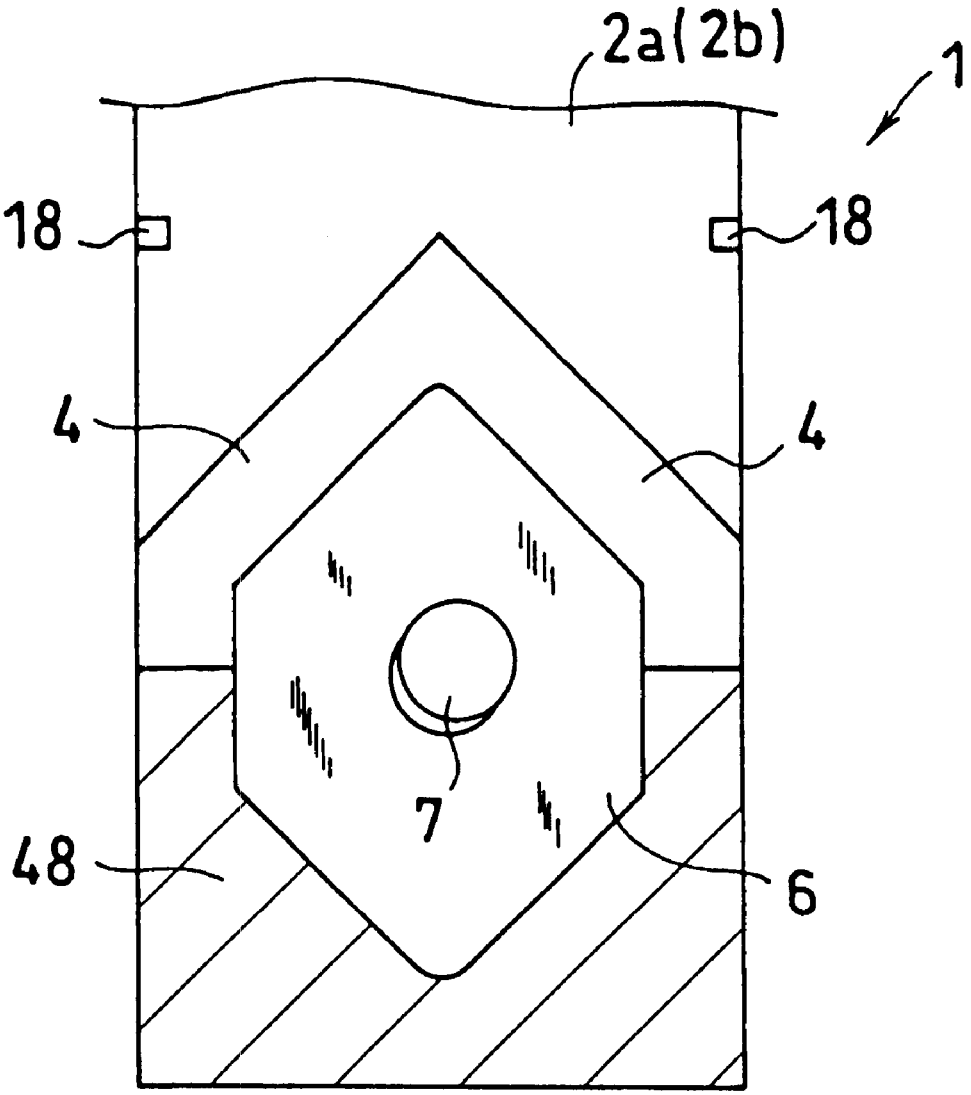
FIG. 23 is a partial front view of a peelable package.
Figure 25A:
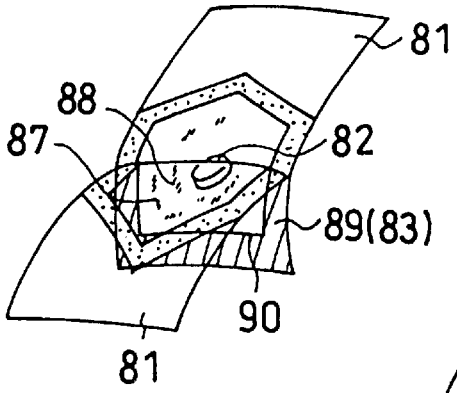
PRIOR ART Fig. 25(A)
FIG. 25(A) is a perspective view of a medicine package while it is opening.
Figure 25B:
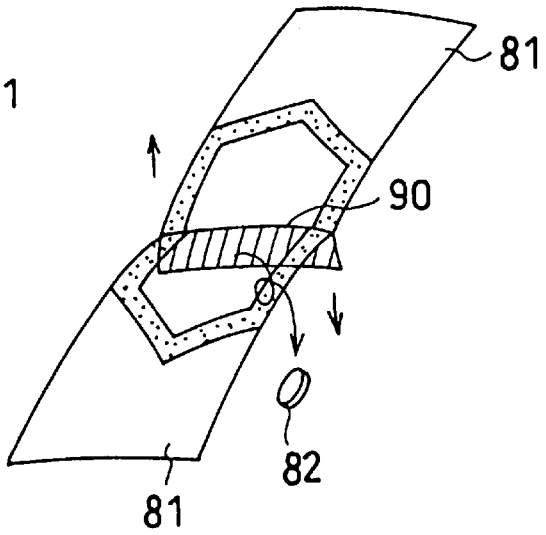
PRIOR ART Fig. 25(B)
FIG. 25(B) is a perspective view showing a weakly-sealed portion opened to its rearmost end.
Figure 26:
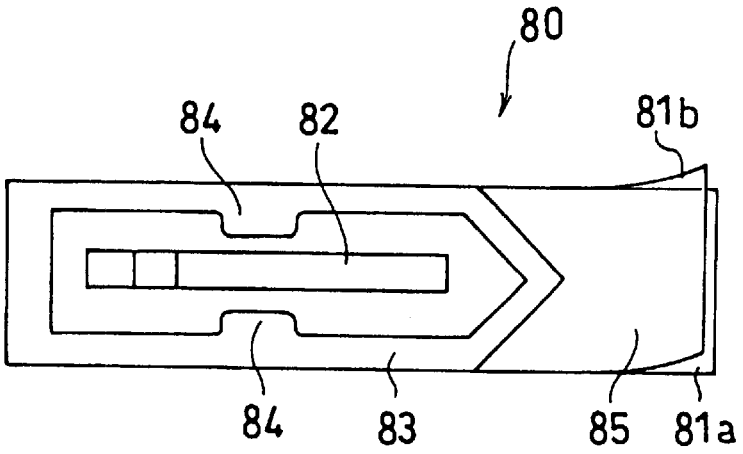
PRIOR ART Fig. 26
FIG. 26 is a front view of a peelable package having a sealing width increased at a midway portion in an opening direction of the weakly-sealed portion.

FIG. 22 and 23 show a fourteenth embodiment. FIG. 22 is a schematic structural view of an apparatus for producing peelable packages. FIG. 23 is a partial front view of a peelable package.

In this fourteenth embodiment, for example, as shown in FIG. 22, the peelable package is produced in the following procedures.

One package sheet 2*a* with a peelable layer 37 formed on one of its surfaces has its predetermined portion brought into contact with a preheating roll 46 to preheat only a further extension area from a mid portion in an opening direction of the weakly-sealed portion 4. Thereafter, it is guided to between a pair of die rolls 40,40. In the meantime, the other package sheet 2*b* is horizontally conveyed. Tablets 7 are supplied on the sheet 2*b* from a tablet supplying device 47, and are spaced apart at a predetermined distance to be guided between the die rolls 40,40 as they are.

The die rolls 40,40 overlay the sheets 2*a*,2*b* one on another with the tablets 7 sandwiched therebetween. The peelable layer 37 is adhered with heat and under pressure to the other package sheet around each of the tablets 7.

As shown in FIG. 23, the heat and pressure adhesion forms the weakly-sealed portion 4 around each tablet. At a portion 48 preheated by the preheating roll 46, the resin particles dispersed in the peelable layer 37 deform as at the resin lump in the eleventh embodiment to thereby increase the adhesion strength here more than at the front end side portion in the opening direction of the weakly-sealed portion 4.

As a result, as the peelable package 1 is going to be opened, the opening resistance is suddenly enhanced when it has reached the preheated portion 48, thereby enabling the opening operation to be surely stopped at this predetermined position.

The fourteenth embodiment has preheated whole the further extension area form the mid portion in the opening direction of the weakly-sealed portion 4. However, it is sufficient if the preheated portion 48 is provided with at least part of the further extension area from the mid portion in the opening direction. For instance, it may be provided only at the position where the resin lump is formed in the eleventh embodiment or the like.

FIG. 24 shows results of Comparison Test 3 obtained by comparing the peeling strength (adhesion strength) at the weakly-sealed portion with that at the resin lump regarding the peelable packages made of the preheated package sheets.

Similarly with the Comparison Test 2, one of the used package sheets comprises a peelable film of 40 $\mu$m thickness formed from polypropylene resin which has a peelable layer on one of its surfaces and polyethylene terephthalate resin of 12 $\mu$m thickness adhered to the peelable film. The other comprises polypropylene resin film of 40 $\mu$m thickness and polyethylene terephthalate resin of 12 $\mu$m thickness adhered thereto.

The sealing temperature was set to 140 degrees C. The sealing pressure was set to 5 kg/cm2 and the package sheets were pressurized for 1.5 seconds between the sealing means.

Apparently from the results of this Comparison Test 3, the peeling strength (adhesion strength) is larger when preheated than when not preheated. Depending on the preheating conditions, it indicates a high value more than twice the value when not preheated.

Besides, the adhesion strength (peeling strength) of the resin lump was increased by preheating. In consequence, a combination of the preheating with the formation of the resin lump can enormously enhance the adhesion strength (peeling strength) when compared with that of the weakly-sealed portion. This results in the possibility of surely stopping the opening operation at this position.

Although each of the above-mentioned embodiments has employed rectangular package sheets, the peelable package of the present invention is applicable to the package material of other shapes such as a circle and an ellipse. In addition, the fourth to sixth inventions are applicable to package containers of other shapes and can properly choose the thickness of the package material. Needless to say, the shapes of the weakly-sealed portion and of the resin lump are not limited to those shown in the embodiments.

In each of the above embodiments, explanation was given for the case of packaging tablets. The peelable package of the present invention is applicable to objects to be packed, which have various shapes and are made of various materials, such as granule, powder and the like pharmaceuticals, foods and various test tools.

Industrial Availability

As mentioned above, the present invention keeps its interior airtight when closed and is advantageous in that even a person having handicapped fingers can open it by an easy operation to take out a packed object safely without dropping it, when desired. It is particularly suitable to pack not only tablets or the like pharmaceuticals and foods, but also various objects to be packed.

What is claimed is:

1. A peelable package comprising:

package sheets for sandwiching objects to be accommodated in a plurality of bag portions defined between said package sheets, said package sheets having grip flaps having a length of at least 10 mm;

weakly-sealed portions arranged so as to surround the objects and so as to form said bag portions, said grip flaps extending from said weakly-sealed portions to an end of said package sheets;

cut lines formed in said package sheets so as to define a plurality of peelable packages, each of said peelable packages having one of said bag portions and one of said grip flaps extending from a respective one of said weakly-sealed portions; and sealed portions for preventing said grip flaps from peeling apart prematurely, said sealed portions being formed along said cut lines at said grip flaps of each of said peelable packages.

2. The peelable package of claim 1, wherein each of said weakly-sealed portions has a front section closest to said grip flaps and a rear section adjacent to said front section and located behind a predetermined position of said bag portion, said rear section having a larger adhesion strength than said front section.

3. The peelable package of claim 2, wherein each of said bag portions comprises a non-sealed area gradually narrowing toward a rear of said bag portion.

4. The peelable package of claim 1, wherein each of said bag portions comprises a non-sealed area gradually narrowing toward a rear of said bag portion.

5. A peelable package comprising:

package materials including a first package material and a second package material, said first package material including a peelable layer formed on a surface thereof, said peelable layer adhering to said second package material so as to form a weakly-sealed portion around an object to be packed between said package materials; and a resin lump formed in a mid-section of said weakly-sealed portion, said resin lump comprising a heated part of a resin of said package materials fluidized and formed such that said resin lump has an adhesion strength greater than an adhesion strength of said weakly-sealed portion.

6. The peelable package of claim 5, wherein said first package material further includes a substrate resin layer, said peelable layer being formed on a surface of said substrate resin layer and being disturbed at said resin lump by fluidized heated resin of said substrate resin layer, said fluidized heated resin of said resin lump adhering directly to said second package material through said disturbed portion of said peelable layer so that an adhesion strength of said resin lump is greater than an adhesion strength of said weakly-sealed portion.

7. The peelable package of claim 5, wherein said peelable layer comprises a first resin material forming a continuous phase and second resin particles dispersed in said first resin material, said second resin particles being fluidized and deformed by heat to enhance the adhesion strength of said resin lump.

8. The peelable package of claim 5, wherein said resin lump is arranged so as to be elongated substantially perpendicular to an opening direction of said weakly-sealed portion.

9. A peelable package comprising:

package materials including a first package material having a peelable layer formed on a surface thereof and a second package material, said peelable layer adhering to said second package material so as to form a weakly-sealed portion around an object to be packed, said peelable layer comprising first resin material forming a continuous phase and second resin particles dispersed in said first resin material;

said weakly-sealed portion including a forward section nearest a first-opened end of said package materials and a rear section, said rear section of said weakly-sealed portion having heat deformed second resin particles dispersed in said first resin material such that an adhesion strength of said rear section is greater than an adhesion strength of said front section.

10. The peelable package of claim 9, wherein said weakly-sealed portion forms a non-sealed area for accommodating the object, said non-sealed area gradually narrowing toward a rear of said package materials.

11. A peelably packaging method comprising:

arranging an object to be packed between a first package material having a peelable layer formed on a surface thereof and a second package material by overlaying the package materials on each other;

guiding the package materials between a pair of sealing means and passing the package materials therethrough;

forming a narrow gap between the sealing means around the packed object so that the package materials adhere to each other by applying heat and pressure so as to form a weakly-sealed portion around the packed object;

forming a wide gap between the sealing means at a position adjacent to the narrow gap for forming the weakly-sealed portion; and fluidizing resin of the first package material by heat and pressure so that the fluidized resin flows into the wide gap to form a resin lump.

12. A peelable package comprising:

package sheets for sandwiching an object to be accommodated in a bag portion defined between said package sheets, said bag portion comprising a non-sealed area;

a weakly-sealed portion arranged so as to surround the object and so as to form said bag portion, said package sheets having grip flaps extending from said weakly-sealed portion, said weakly-sealed portion being adapted to be peeled apart by grasping said grip flaps and pulling apart said package sheets so as to remove the object from said non-sealed area; and a sealed portion for preventing said grip flaps from peeling apart prematurely, said sealed portions being formed in said grip flaps nearer to a first-opened end of said package sheets than is a forward tip of said weakly-sealed portion.

13. The peelable package of claim 12, wherein said grip flaps extend from said weakly-sealed portion to a forward end of said package sheets and have a length of at least 10 mm.

14. The peelable package of claim 12, wherein said grip flaps have a length in a range of 20 mm to 100 mm.

15. The peelable package of claim 12, wherein said grip flaps have a length in a range of 30 mm to 50 mm.

* * * * *